US012038239B2

(12) United States Patent
Mondaru et al.

(10) Patent No.: US 12,038,239 B2
(45) Date of Patent: Jul. 16, 2024

(54) HEAT EXCHANGER, METHOD FOR MANUFACTURING HEAT EXCHANGER, AND REFRIGERANT CYCLE APPARATUS

(71) Applicant: DAIKIN INDUSTRIES, LTD., Osaka (JP)

(72) Inventors: Debukuma-ru Mondaru, Osaka (JP); Tomohiro Nagano, Osaka (JP); Hirokazu Fujino, Osaka (JP); Ken Satou, Osaka (JP); Kiyotaka Toyoyama, Osaka (JP); Takuya Ukai, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/979,253

(22) Filed: Nov. 2, 2022

(65) Prior Publication Data

US 2023/0063016 A1 Mar. 2, 2023

Related U.S. Application Data

(63) Continuation of application No. PCT/JP2021/019480, filed on May 21, 2021.

(30) Foreign Application Priority Data

May 22, 2020 (JP) ..... 2020-089353

(51) Int. Cl.
*F28F 13/18* (2006.01)
*F25B 39/02* (2006.01)
*F28F 1/32* (2006.01)

(52) U.S. Cl.
CPC ..... *F28F 13/18* (2013.01); *F25B 39/02* (2013.01); *F28F 1/32* (2013.01)

(58) Field of Classification Search
CPC ..... F28F 13/18; F28F 1/32; F28F 2245/00; F28F 2240/02; F28F 2240/04; F28F 2240/06; F28F 2240/08; F25B 39/02
(Continued)

(56) References Cited

U.S. PATENT DOCUMENTS

2017/0227305 A1 8/2017 Yamada et al.
2020/0088432 A1 3/2020 Nagano et al.

FOREIGN PATENT DOCUMENTS

EP 3594603 A1 1/2020
JP H04-178472 A 6/1992
(Continued)

OTHER PUBLICATIONS

Pdf is original documentor foreign reference WO 2012147288 A1 (Year: 2012).*

(Continued)

*Primary Examiner* — Len Tran
*Assistant Examiner* — Kamran Tavakoldavani
(74) *Attorney, Agent, or Firm* — Osha Bergman Watanabe & Burton LLP

(57) ABSTRACT

A heat exchanger includes: a water-repellent coating film on part of a surface of the heat exchanger. The surface on which the water-repellent coating film is disposed includes a surface structure including protrusions. $D/L<0.36$, $D/L>0.4\times(L/H)$, $D<200$, $L-D<1000$, $H>700$, $0>1.28\times D\times10^{-2}+2.77\times(L-D)\times10^{-3}-1.1\times D^2\times10^{-5}-5.3\times(L-D)^2\times10^{-7}-9.8\times D\times(L-D)\times10^{-6}-2.0$, and $90°<\theta<120°$, where L is an average pitch of the protrusions in nm, D is an average diameter of the protrusions in nm, H is an average height of the protrusions in nm, and θ is a contact angle of water on a smooth plane of the water-repellent coating film.

8 Claims, 17 Drawing Sheets

(58) Field of Classification Search
USPC ..... 165/133
See application file for complete search history.

(56) References Cited

FOREIGN PATENT DOCUMENTS

| | | | | | |
|---|---|---|---|---|---|
| JP | 2002071295 | A | | 3/2002 | |
| JP | 2003073853 | A | | 3/2003 | |
| JP | 2006043510 | A | | 2/2006 | |
| JP | 2011-122769 | A | | 6/2011 | |
| JP | 2014-214368 | A | | 11/2014 | |
| JP | 2015-183926 | A | | 10/2015 | |
| JP | 5867325 | B2 | | 2/2016 | |
| JP | 2017-15377 | A | | 1/2017 | |
| JP | 2017-115219 | A | | 6/2017 | |
| JP | 2018-173265 | A | | 11/2018 | |
| JP | 2019-2587 | A | | 1/2019 | |
| WO | 2011096124 | A1 | | 8/2011 | |
| WO | WO-2012147288 | A1 | * | 11/2012 | ..... F28F 1/128 |
| WO | 2016/021367 | A1 | | 2/2016 | |

OTHER PUBLICATIONS

Pdf is translation of foreign reference WO-2012147288-A1 (Year: 2012).*
Pdf is original document of foreign reference WO 2012147288 A1 (Year: 2012).*
International Search Report issued in corresponding International Application No. PCT/JP2021/019480 dated Jul. 27, 2021 (3 pages).
International Preliminary Report on Patentability issued in corresponding International Application No. PCT/JP2021/019480 dated Nov. 17, 2022 (7 pages).
Extended European Search Report issued in corresponding European Patent Application No. 21809042.1 dated Sep. 6, 2023 (10 pages).

* cited by examiner

HEAT EXCHANGER, METHOD FOR MANUFACTURING HEAT EXCHANGER, AND REFRIGERANT CYCLE APPARATUS

CROSS-REFERENCE TO RELATED APPLICATIONS

This is a continuation application of International Patent Application No. PCT/JP2021/019480, filed on May 21, 2021, and claims priority to Japanese Patent Application No. 2020-089353, filed on May 22, 2020. The contents of these priority applications are incorporated herein by reference.

TECHNICAL FIELD

The present disclosure relates to a heat exchanger, a method for manufacturing a heat exchanger, and a refrigerant cycle apparatus.

BACKGROUND

A heat exchanger used as an evaporator of a refrigerant in a refrigerant cycle apparatus, such as an air conditioning apparatus, is known.

In a case where the heat exchanger is used in an environment where the temperature and humidity satisfy specific conditions, frost adheres to the surface, and the growth of the frost may increase the air flow resistance of the heat exchanger.

When the air flow resistance of the heat exchanger increases in this way, the heat exchange efficiency in the heat exchanger decreases. Therefore, in a case where the amount of adhering frost increases, the air flow resistance in the heat exchanger can be reduced by performing operation for melting the frost (defrosting operation) or the like.

However, when the defrosting operation for melting the frost is frequently performed, original operation in which the heat exchanger is caused to function as an evaporator of the refrigerant to process the heat load is inhibited.

Regarding such a problem, Patent Document 1 (Japanese Unexamined Patent Application Publication No. 2018-173265) discloses a heat exchanger having a surface structure in which a plurality of protrusions having a predetermined shape and a water-repellent coating film are provided. In the surface structure, energy due to combination of condensed water (water droplets) having droplet diameters capable of maintaining a supercooled state even under a predetermined freezing condition can separate the droplets after the combination. Since the heat exchanger disclosed in Patent Document 1 can suppress frost formation by separating (scattering) condensed water after the combination, it is possible to suppress the heat-load processing from being inhibited by frequent defrosting operation.

SUMMARY

A heat exchanger of one or more embodiments is a heat exchanger provided with a water-repellent coating film on part of a surface of the heat exchanger. The surface on which the water-repellent coating film is provided has a surface structure including a plurality of protrusions, and satisfies all relationships $$D/L<0.36,$$

$$D/L>0.4\times(L/H),$$

$$D<200\text{ nm},$$

$$L-D<1000\text{ nm}$$

$$H>700\text{ nm},$$

$$\theta>1.28\times D\times10^{-2}+2.77\times(L-D)\times10^{-3}-1.1\times D^2\times10^{-5}-5.3\times(L-D)^2\times10^{-7}-9.8\times D\times(L-D)\times10^{-6}-2.0,\text{ and}$$

$$90°<\theta<120°,\text{ where}$$

L: an average pitch of the plurality of protrusions (nm),

D: an average diameter of the plurality of protrusions (nm),

H: an average height of the plurality of protrusions (nm), and

θ: a contact angle of water on a smooth plane of the water-repellent coating film.

DETAILED DESCRIPTION

(1) Refrigerant Cycle Apparatus 100

Figure 1:
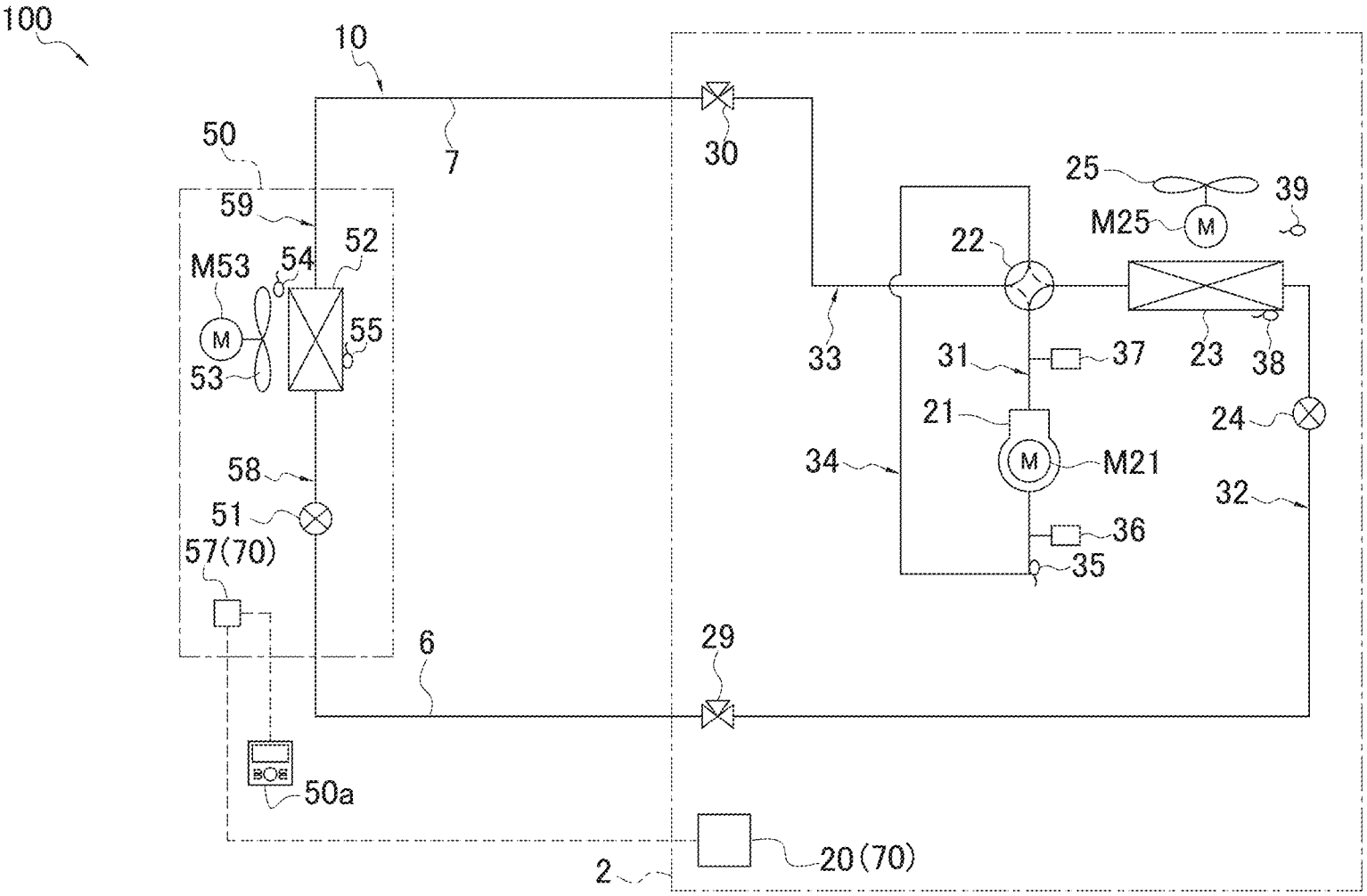
FIG. 1 is a schematic configuration diagram including a refrigerant circuit of a refrigerant cycle apparatus.

FIG. 1 is a schematic configuration diagram of a refrigerant cycle apparatus 100 according to one or more embodiments. The refrigerant cycle apparatus 100 is an apparatus that conditions air in a target space by performing a vapor compression refrigerant cycle (refrigeration cycle).

The refrigerant cycle apparatus 100 mainly includes an outdoor unit 2, an indoor unit 50, a liquid-refrigerant connection pipe 6 and a gas-refrigerant connection pipe 7 that connect the outdoor unit 2 and the indoor unit 50 to each other, a plurality of remote controllers 50*a* as input devices and output devices, and a controller 70 that controls the operation of the refrigerant cycle apparatus 100.

In the refrigerant cycle apparatus 100, a refrigerant cycle is performed in which the refrigerant sealed in a refrigerant circuit 10 is compressed, cooled or condensed, decompressed, heated or evaporated, and then compressed again. In one or more embodiments, the refrigerant circuit 10 is filled with R32 as the refrigerant for performing a vapor compression refrigerant cycle.

(1-1) Outdoor Unit 2

The outdoor unit 2 is connected to the indoor unit 50 via the liquid-refrigerant connection pipe 6 and the gas-refrigerant connection pipe 7, and constitutes part of the refrigerant circuit 10. The outdoor unit 2 mainly includes a compressor 21, a four-way switching valve 22, an outdoor heat exchanger 23, an outdoor expansion valve 24, an outdoor fan 25, a liquid-side shutoff valve 29, a gas-side shutoff valve 30, and an outdoor casing 2*a*.

Further, the outdoor unit 2 includes a discharge pipe 31, a suction pipe 34, an outdoor gas-side pipe 33, and an outdoor liquid-side pipe 32, which are pipes constituting the refrigerant circuit 10. The discharge pipe 31 connects the discharge side of the compressor 21 and a first connection port of the four-way switching valve 22 to each other. The suction pipe 34 connects the suction side of the compressor 21 and a second connection port of the four-way switching valve 22 to each other. The outdoor gas-side pipe 33 connects a third port of the four-way switching valve 22 and the gas-side shutoff valve 30 to each other. The outdoor liquid-side pipe 32 extends from a fourth port of the four-way switching valve 22 to the liquid-side shutoff valve 29 via the outdoor heat exchanger 23 and the outdoor expansion valve 24.

The compressor 21 is equipment that compresses a low-pressure refrigerant in the refrigerant cycle to a high pressure. Here, used as the compressor 21 is a compressor having a closed structure in which a positive-displacement-type compression element (not illustrated), such as a rotary type or a scroll type, is rotationally driven by a compressor motor M21. The compressor motor M21 is for changing the displacement, and the operating frequency can be controlled by an inverter.

The four-way switching valve 22 can switch the connection states to switch between a cooling-operation connection state (and a defrosting-operation state) in which the discharge side of the compressor 21 and the outdoor heat exchanger 23 are connected to each other and the suction side of the compressor 21 and the gas-side shutoff valve 30 are connected to each other, and a heating-operation connection state in which the discharge side of the compressor 21 and the gas-side shutoff valve 30 are connected to each other and the suction side of the compressor 21 and the outdoor heat exchanger 23 are connected to each other.

The outdoor heat exchanger 23 is a heat exchanger that functions as a radiator of high-pressure refrigerant in the refrigerant cycle during cooling operation, and functions as an evaporator of low-pressure refrigerant in the refrigerant cycle during heating operation.

The outdoor fan 25 is a fan that generates an air flow for sucking outdoor air into the outdoor unit 2, causing the air to exchange heat with the refrigerant in the outdoor heat exchanger 23, and then releasing the air to the outside. The outdoor fan 25 is rotationally driven by an outdoor fan motor M25.

The outdoor expansion valve 24 is an electric expansion valve whose valve opening degree can be controlled. The outdoor expansion valve 24 is provided between the outdoor heat exchanger 23 and the liquid-side shutoff valve 29 in the outdoor liquid-side pipe 32.

The liquid-side shutoff valve 29 is a manual valve arranged at a connection portion between the outdoor liquid-side pipe 32 and the liquid-refrigerant connection pipe 6.

The gas-side shutoff valve 30 is a manual valve arranged at a connection portion between the outdoor gas-side pipe 33 and the gas-refrigerant connection pipe 7.

Various sensors are arranged in the outdoor unit 2.

Specifically, arranged around the compressor 21 of the outdoor unit 2 are a suction temperature sensor 35 that detects a suction temperature that is the temperature of the refrigerant on the suction side of the compressor 21, a suction pressure sensor 36 that detects a suction pressure that is the pressure of the refrigerant on the suction side of the compressor 21, and a discharge pressure sensor 37 that detects a discharge pressure that is the pressure of the refrigerant on the discharge side of the compressor 21.

Further, the outdoor heat exchanger 23 is provided with an outdoor heat-exchange temperature sensor 38 that detects the temperature of the refrigerant flowing through the outdoor heat exchanger 23.

In addition, an outside-air temperature sensor 39 that detects the temperature of outdoor air sucked into the outdoor unit 2 is arranged around the outdoor heat exchanger 23 or the outdoor fan 25.

The outdoor unit 2 includes an outdoor-unit control unit (i.e., outdoor-unit controller) 20 that controls the operation of each unit constituting the outdoor unit 2. The outdoor-unit control unit 20 includes a microcomputer including a central processing unit (CPU), a memory, and the like. The outdoor-unit control unit 20 is connected to an indoor-unit control unit (i.e., indoor-unit controller) 57 of the indoor unit 50 via a communication line, and transmits and receives control signals and the like. Further, the outdoor-unit control unit 20 is electrically connected to each of the suction temperature sensor 35, the suction pressure sensor 36, the discharge pressure sensor 37, the outdoor heat-exchange temperature sensor 38, and the outside-air temperature sensor 39, and receives signals from the respective sensors.

Figure 3:
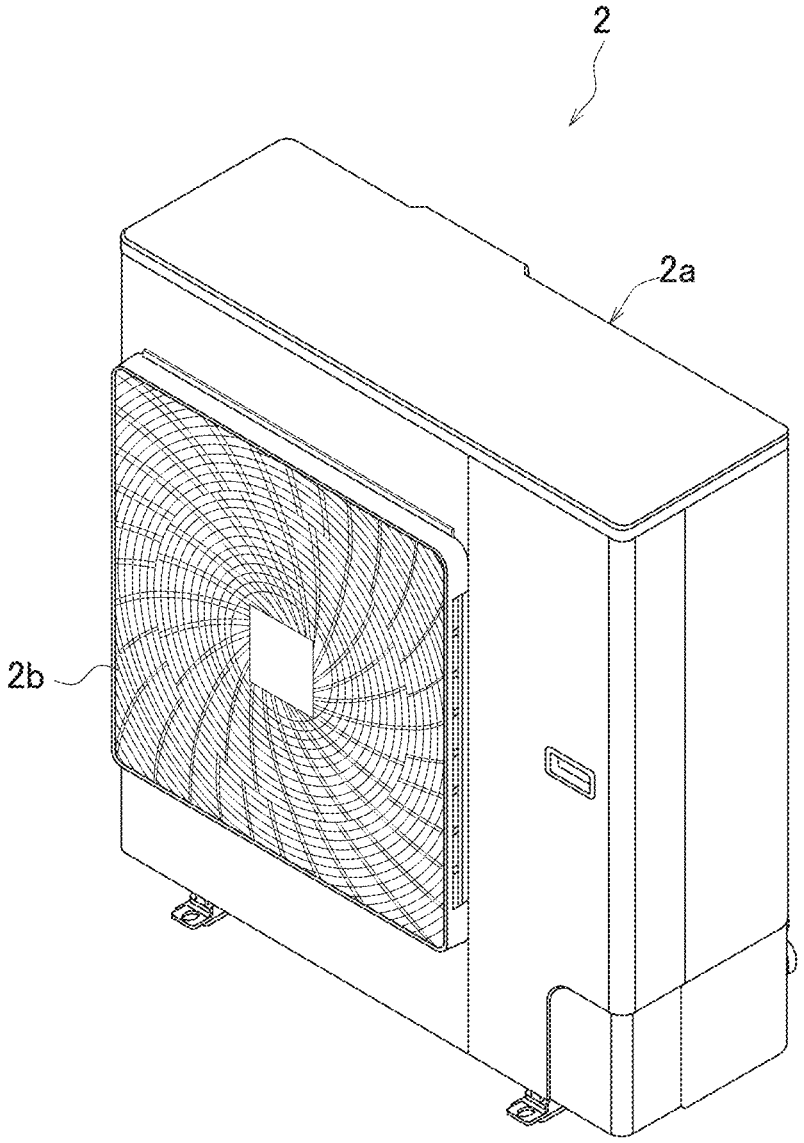
FIG. 3 is an external perspective view of an outdoor unit.
Figure 4:
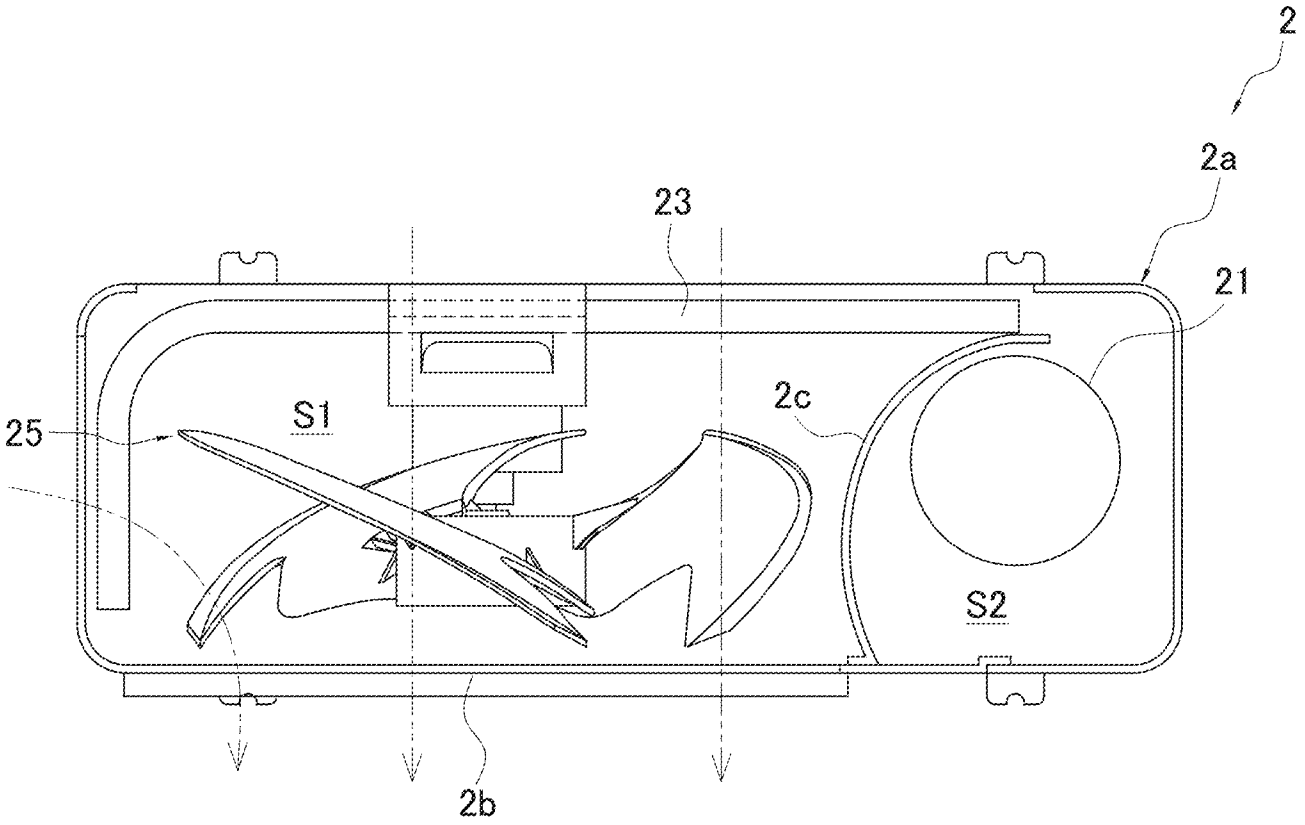
FIG. 4 is a seen-from-above arrangement configuration diagram of the outdoor unit.

Note that each element constituting the outdoor unit 2 described above is accommodated in the outdoor casing 2*a* as illustrated in an external perspective view in FIG. 3 and a seen-from-above arrangement configuration diagram in FIG. 4. The outdoor casing 2*a* is partitioned into a fan chamber S1 and a machine chamber S2 by a partition plate 2*c*. The outdoor heat exchanger 23 is provided in a posture of being erected in a vertical direction, with the main surface of the outdoor heat exchanger 23 expanding, in the fan chamber S1, at the back surface of the outdoor casing 2*a* and a side surface of the outdoor casing 2*a* on the side opposite to the machine chamber S2. The outdoor fan 25 is a propeller fan whose rotation axis direction is a front-rear direction, takes in air in a substantially horizontal direction toward the inside in the fan chamber S1 from the back surface of the outdoor casing 2*a* and from the side surface of the outdoor casing 2*a* opposite to the machine chamber S2, and forms an air flow that blows out in a substantially horizontal direction toward the front via a fan grill 2*b* provided in the front surface in the fan chamber 51 of the outdoor casing 2*a* (see two-dot-chain-line arrows in FIG. 4). With the above-described configuration, the air flow formed by the outdoor fan 25 passes orthogonally to the main surface of the outdoor heat exchanger 23.

(1-2) Indoor Unit 50

The indoor unit 50 is installed on a wall surface, a ceiling, or the like in a room that is a target space. The indoor unit 50 is connected to the outdoor unit 2 via the liquid-refrigerant connection pipe 6 and the gas-refrigerant connection pipe 7, and constitutes part of the refrigerant circuit 10.

The indoor unit 50 includes an indoor expansion valve 51, an indoor heat exchanger 52, and an indoor fan 53.

Further, the indoor unit 50 includes an indoor liquid-refrigerant pipe 58 that connects the liquid-side end of the indoor heat exchanger 52 and the liquid-refrigerant connection pipe 6 to each other, and an indoor gas-refrigerant pipe 59 that connects the gas-side end of the indoor heat exchanger 52 and the gas-refrigerant connection pipe 7 to each other.

The indoor expansion valve 51 is an electric expansion valve whose valve opening degree can be controlled, and is provided in the indoor liquid-refrigerant pipe 58.

The indoor heat exchanger 52 is a heat exchanger that functions as an evaporator of low-pressure refrigerant in the refrigerant cycle during cooling operation, and functions as a radiator of high-pressure refrigerant in the refrigerant cycle during heating operation.

The indoor fan 53 sucks indoor air into the indoor unit 50, causes the air to exchange heat with the refrigerant in the indoor heat exchanger 52, and then generates an air flow for releasing the air to the outside. The indoor fan 53 is rotationally driven by an indoor fan motor M53.

Various sensors are arranged in the indoor unit 50.

Specifically, arranged inside the indoor unit 50 are an indoor air temperature sensor 54 that detects the air temperature in the space in which the indoor unit 50 is installed, and an indoor heat-exchange temperature sensor 55 that detects the temperature of the refrigerant flowing through the indoor heat exchanger 52.

Further, the indoor unit 50 includes the indoor-unit control unit 57 that controls the operation of each unit constituting the indoor unit 50. The indoor-unit control unit 57 includes a microcomputer including a CPU, a memory, and the like. The indoor-unit control unit 57 is connected to the outdoor-unit control unit 20 via the communication line, and transmits and receives control signals and the like.

The indoor air temperature sensor 54 and the indoor heat-exchange temperature sensor 55 are each electrically connected to the indoor-unit control unit 57, and the indoor-unit control unit 57 receives signals from the respective sensors.

(1-3) Remote Controller 50*a*

The remote controller 50*a* is an input device for the user of the indoor unit 50 to input various instructions for switching the operation states of the refrigerant cycle apparatus 100. Further, the remote controller 50*a* also functions as an output device for performing predetermined notifications, such as the operation state of the refrigerant cycle apparatus 100. The remote controller 50*a* is connected to the indoor-unit control unit 57 via a communication line, and transmits and receives signals to and from each other.

(2) Details of Controller 70

In the refrigerant cycle apparatus 100, the outdoor-unit control unit 20 and the indoor-unit control unit 57 are connected to each other via the communication line to constitute the controller 70 that controls the operation of the refrigerant cycle apparatus 100.

Figure 2:
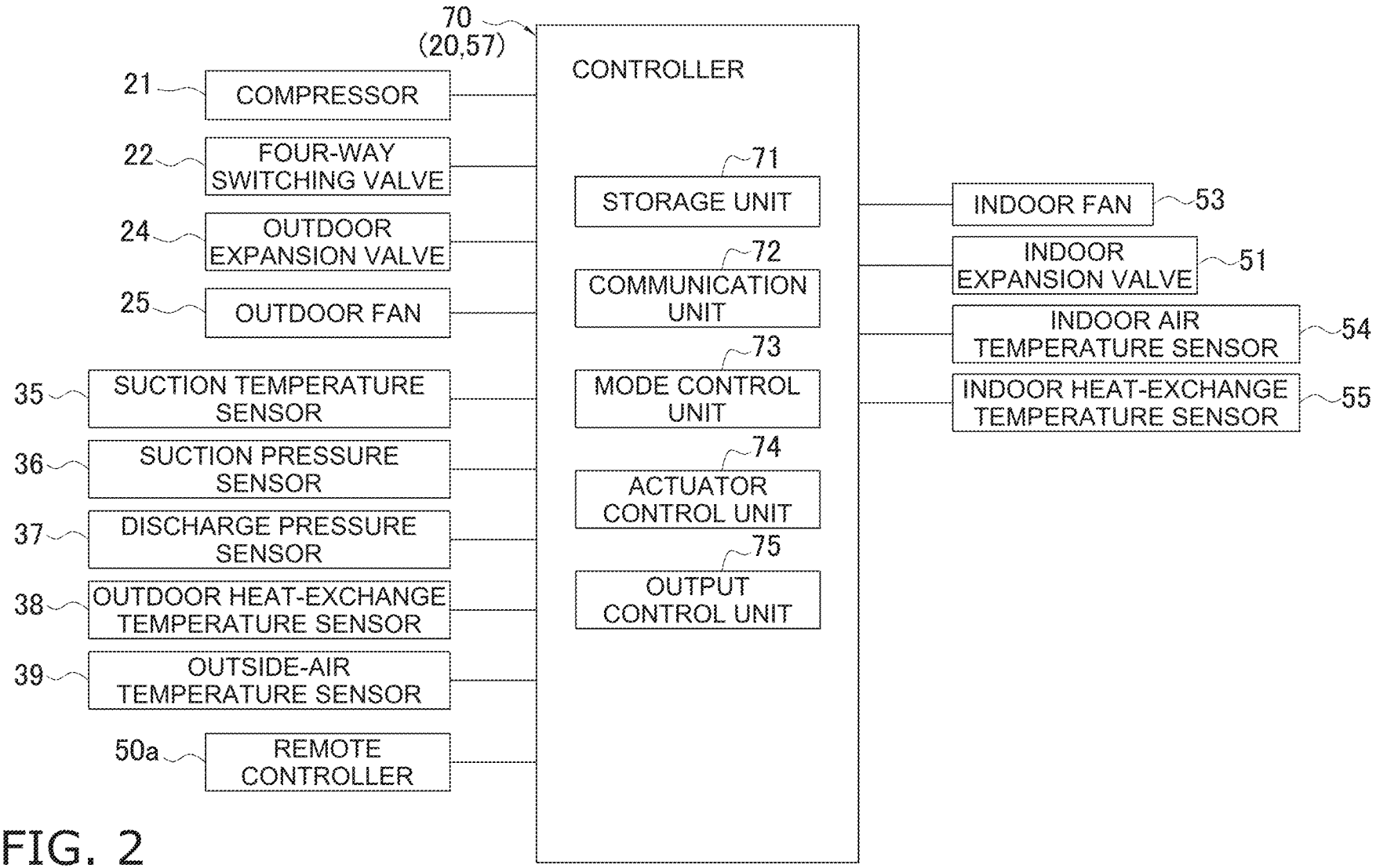
FIG. 2 is a schematic block configuration diagram of the refrigerant cycle apparatus.

FIG. 2 is a block diagram schematically illustrating a schematic configuration of the controller 70 and each unit connected to the controller 70.

The controller 70 has a plurality of control modes, and controls the operation of the refrigerant cycle apparatus 100 according to the control mode. For example, the controller 70 has a cooling-operation mode, a heating-operation mode, and a defrosting-operation mode as the control modes.

The controller 70 is electrically connected to each actuator included in the outdoor unit 2 (specifically, the compressor 21 (the compressor motor M21), the outdoor expansion valve 24, and the outdoor fan 25 (the outdoor fan motor M25)), and various sensors (the suction temperature sensor 35, the suction pressure sensor 36, the discharge pressure sensor 37, the outdoor heat-exchange temperature sensor 38, the outside-air temperature sensor 39, and the like). Further, the controller 70 is electrically connected to actuators included in the indoor unit 50 (specifically, the indoor fan 53 (the indoor fan motor M53) and the indoor expansion valve 51). Further, the controller 70 is electrically connected to the indoor air temperature sensor 54, the indoor heat-exchange temperature sensor 55, and the remote controller 50*a*.

The controller 70 mainly includes a storage unit 71, a communication unit 72, a mode control unit 73, an actuator control unit 74, and an output control unit 75. Note that each unit in the controller 70 is implemented by respective units included in the outdoor-unit control unit 20 and/or the indoor-unit control unit 57 functioning together.

(2-1) Storage Unit 71

The storage unit 71 is constituted by, for example, a ROM, a RAM, a flash memory, and the like, and includes a volatile storage area and a nonvolatile storage area. The storage unit 71 stores control programs that define processing in each unit of the controller 70. Further, each unit of the controller 70 appropriately stores predetermined information (for example, a detection value of each sensor, a command input into the remote controller 50*a*, and the like) in a predetermined storage area in the storage unit 71.

(2-2) Communication Unit 72

The communication unit 72 is a functional unit that serves as a communication interface for transmitting and receiving signals to and from each equipment connected to the controller 70. The communication unit 72 receives a request from the actuator control unit 74 and transmits a predetermined signal to the designated actuator. Further, the communication unit 72 receives signals output from the various sensors 35 to 39, 54, and 55, and the remote controllers 50*a*, and stores the signals in a predetermined storage area of the storage unit 71.

(2-3) Mode Control Unit 73

The mode control unit 73 is a functional unit that performs switching between the control modes, and the like. The mode control unit 73 switches and executes the cooling-operation mode, the heating-operation mode, and the defrosting-operation mode according to an input from the remote controller 50*a* and the operation situation.

(2-4) Actuator Control Unit 74

The actuator control unit 74 controls the operation of each actuator (for example, the compressor 21 or the like)

included in the refrigerant cycle apparatus 100 according to a situation in accordance with the control programs.

For example, the actuator control unit 74 controls the number of rotations of the compressor 21, the connection state of the four-way switching valve 22, the numbers of rotations of the outdoor fan 25 and the indoor fan 53, the valve opening degree of the outdoor expansion valve 24, the valve opening degree of the indoor expansion valve 51, and the like in real time according to a set temperature, the detection values of the various sensors, the control mode, and the like.

(2-5) Output Control Unit 75

The output control unit 75 is a functional unit that controls the operation of the remote controller 50*a* as a display device.

The output control unit 75 causes the remote controller 50*a* to output predetermined information in order to display, for a user, information related to the operation state and the situation.

(3) Various Operation Modes

Hereinafter, refrigerant flows in the cooling-operation mode, the heating-operation mode, and the defrosting-operation mode will be described.

(3-1) Cooling-Operation Mode

In the refrigerant cycle apparatus 100, the mode control unit 73 switches the control mode to the cooling-operation mode, so that the actuator control unit 74 switches the connection state of the four-way switching valve 22 to the cooling-operation connection state in which the suction side of the compressor 21 and the gas-side shutoff valve 30 are connected to each other while the discharge side of the compressor 21 and the outdoor heat exchanger 23 are connected to each other. Thus, the refrigerant with which the refrigerant circuit 10 is filled mainly circulates through the compressor 21, the outdoor heat exchanger 23, the outdoor expansion valve 24, the indoor expansion valve 51, and the indoor heat exchanger 52 in this order.

More specifically, when the operation mode is switched to the cooling-operation mode, in the refrigerant circuit 10, the refrigerant is sucked into the compressor 21, compressed, and then discharged.

The gas refrigerant discharged from the compressor 21 flows into the gas-side end of the outdoor heat exchanger 23 through the discharge pipe 31 and the four-way switching valve 22.

The gas refrigerant that has flowed into the gas-side end of the outdoor heat exchanger 23 exchanges heat with outdoor-side air supplied by the outdoor fan 25 in the outdoor heat exchanger 23 to radiate heat and condense, becomes liquid refrigerant, and flows out from the liquid-side end of the outdoor heat exchanger 23.

The liquid refrigerant that has flowed out from the liquid-side end of the outdoor heat exchanger 23 flows into the indoor unit 50 through the outdoor liquid-side pipe 32, the outdoor expansion valve 24, the liquid-side shutoff valve 29, and the liquid-refrigerant connection pipe 6. Note that in the cooling-operation mode, the outdoor expansion valve 24 is controlled so as to be in a fully open state.

The refrigerant that has flowed into the indoor unit 50 flows into the indoor expansion valve 51 through part of the indoor liquid-refrigerant pipe 58. The refrigerant that has flowed into the indoor expansion valve 51 is decompressed to a low pressure in the refrigerant cycle by the indoor expansion valve 51, and then flows into the liquid-side end of the indoor heat exchanger 52. Note that in the cooling-operation mode, the valve opening degree of the indoor expansion valve 51 is controlled so that the degree of superheating of the refrigerant sucked into the compressor 21 becomes a predetermined degree of superheating. Here, the degree of superheating of the refrigerant sucked into the compressor 21 is calculated by the controller 70 using the temperature detected by the suction temperature sensor 35 and the pressure detected by the suction pressure sensor 36. The refrigerant that has flowed into the liquid-side end of the indoor heat exchanger 52 exchanges heat with indoor air supplied by the indoor fan 53 in the indoor heat exchanger 52, evaporates, becomes gas refrigerant, and flows out from the gas-side end of the indoor heat exchanger 52. The gas refrigerant that has flowed out from the gas-side end of the indoor heat exchanger 52 flows into the gas-refrigerant connection pipe 7 via the indoor gas-refrigerant pipe 59.

In this way, the refrigerant flowing through the gas-refrigerant connection pipe 7 is sucked into the compressor 21 again through the gas-side shutoff valve 30, the outdoor gas-side pipe 33, the four-way switching valve 22, and the suction pipe 34.

(3-2) Heating-Operation Mode

In the refrigerant cycle apparatus 100, the mode control unit 73 switches the control mode to the heating-operation mode, so that the actuator control unit 74 switches the connection state of the four-way switching valve 22 to the heating-operation connection state in which the suction side of the compressor 21 and the outdoor heat exchanger 23 are connected to each other while the discharge side of the compressor 21 and the gas-side shutoff valve 30 are connected to each other. Thus, the refrigerant with which the refrigerant circuit 10 is filled mainly circulates through the compressor 21, the indoor heat exchanger 52, the indoor expansion valve 51, the outdoor expansion valve 24, and the outdoor heat exchanger 23 in this order.

More specifically, when the operation mode is switched to the heating-operation mode, in the refrigerant circuit 10, the refrigerant is sucked into the compressor 21, compressed, and then discharged.

The gas refrigerant discharged from the compressor 21 flows through the discharge pipe 31, the four-way switching valve 22, the outdoor gas-side pipe 33, and the gas-refrigerant connection pipe 7, and then flows into the indoor unit 50 via the indoor gas-refrigerant pipe 59.

The refrigerant that has flowed into the indoor unit 50 flows into the gas-side end of the indoor heat exchanger 52 through the indoor gas-refrigerant pipe 59. The refrigerant that has flowed into the gas-side end of the indoor heat exchanger 52 exchanges heat with indoor air supplied by the indoor fan 53 in the indoor heat exchanger 52 to radiate heat and condense, becomes liquid refrigerant, and flows out from the liquid-side end of the indoor heat exchanger 52. The refrigerant that has flowed out from the liquid-side end of the indoor heat exchanger 52 flows into the liquid-refrigerant connection pipe 6 via the indoor liquid-refrigerant pipe 58 and the indoor expansion valve 51. Note that in the heating-operation mode, the valve opening degree of the indoor expansion valve 51 is controlled so as to be in a fully open state.

In this way, the refrigerant flowing through the liquid-refrigerant connection pipe 6 flows into the outdoor expansion valve 24 via the liquid-side shutoff valve 29 and the outdoor liquid-side pipe 32.

The refrigerant that has flowed into the outdoor expansion valve 24 is decompressed to a low pressure in the refrigerant cycle, and then flows into the liquid-side end of the outdoor heat exchanger 23. Note that in the heating-operation mode, the valve opening degree of the outdoor expansion valve 24 is controlled such that the degree of superheating of the refrigerant sucked into the compressor 21 becomes a predetermined degree of superheating.

The refrigerant that has flowed into from the liquid-side end of the outdoor heat exchanger 23 exchanges heat with outdoor air supplied by the outdoor fan 25 in the outdoor heat exchanger 23 to evaporate, becomes gas refrigerant, and flows out from the gas-side end of the outdoor heat exchanger 23.

The refrigerant that has flowed out from the gas-side end of the outdoor heat exchanger 23 is sucked into the compressor 21 again through the four-way switching valve 22 and the suction pipe 34.

(3-3) Defrosting-Operation Mode

As described above, in a case where the heating-operation mode is executed, when a predetermined frost formation condition is satisfied, the mode control unit 73 temporarily interrupts the heating-operation mode, and switches the control mode to the defrosting-operation mode for melting the frost that has adhered to the outdoor heat exchanger 23.

Note that the predetermined frost formation condition is not limited, but can be, for example, a fact that a state in which the temperature detected by the outside-air temperature sensor 39 and the temperature detected by the outdoor heat-exchange temperature sensor 38 satisfy a predetermined temperature condition continues for a predetermined time or more.

In the defrosting-operation mode, the actuator control unit 74 drives the compressor 21, with the connection state of the four-way switching valve 22 made similar to the connection state during the cooling operation, and with the driving of the indoor fan 53 stopped. After the defrosting-operation mode is started, in a case where a predetermined defrosting end condition is satisfied (for example, in a case where a predetermined time elapses after the defrosting-operation mode is started, or the like), the actuator control unit 74 returns the connection state of the four-way switching valve 22 to the connection state during the heating operation again, and restarts the heating-operation mode.

(4) Structure of Outdoor Heat Exchanger 23

Figure 5:
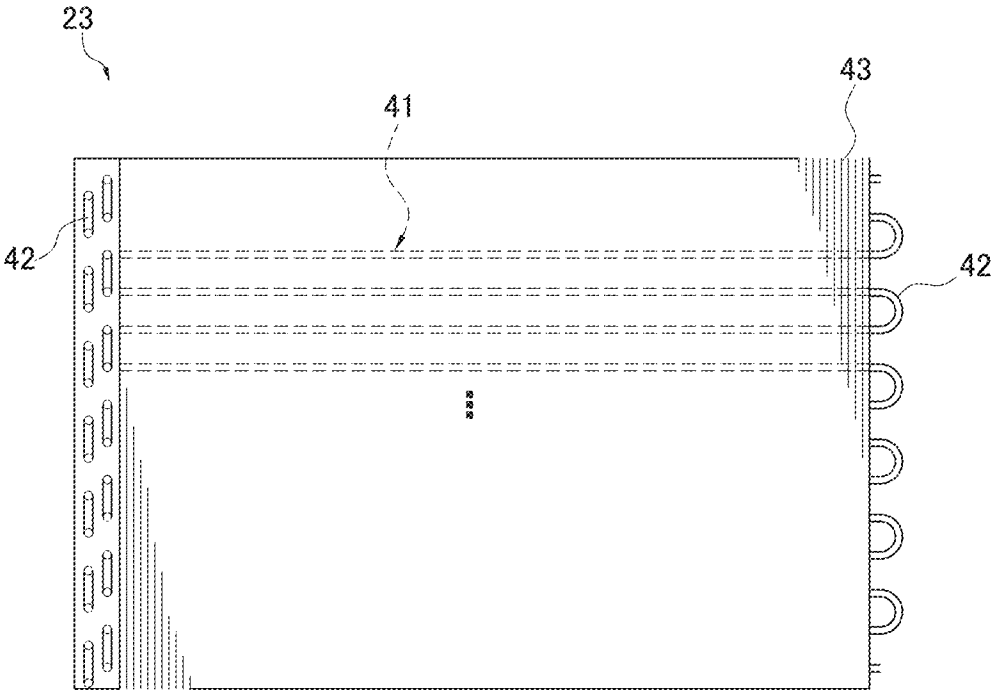
FIG. 5 is a schematic front view of an outdoor heat exchanger.

As illustrated in a schematic front view of the outdoor heat exchanger 23 in FIG. 5, the outdoor heat exchanger 23 includes a plurality of heat transfer tubes 41 extending in a horizontal direction, a plurality of U-shaped tubes 42 connecting end portions of the heat transfer tubes 41 to each other, and a plurality of fins 43 (heat transfer fins) spreading vertically and in an air flow direction.

The heat transfer tubes 41 are composed of copper, a copper alloy, aluminum, an aluminum alloy, or the like. As illustrated in a schematic external view in FIG. 6 of the fin 43 as viewed in a direction normal to a main surface of the fin 43, the heat transfer tubes 41 are fixed to the fins 43 and used, in such a manner that the heat transfer tubes 41 pass through insertion openings 43*a* provided in the fins 43. Note that the U-shaped tubes 42 are connected to end portions of the heat transfer tubes 41 in order to turn back the refrigerant flowing inside.

(5) Structure of Fin 43

Figure 7:
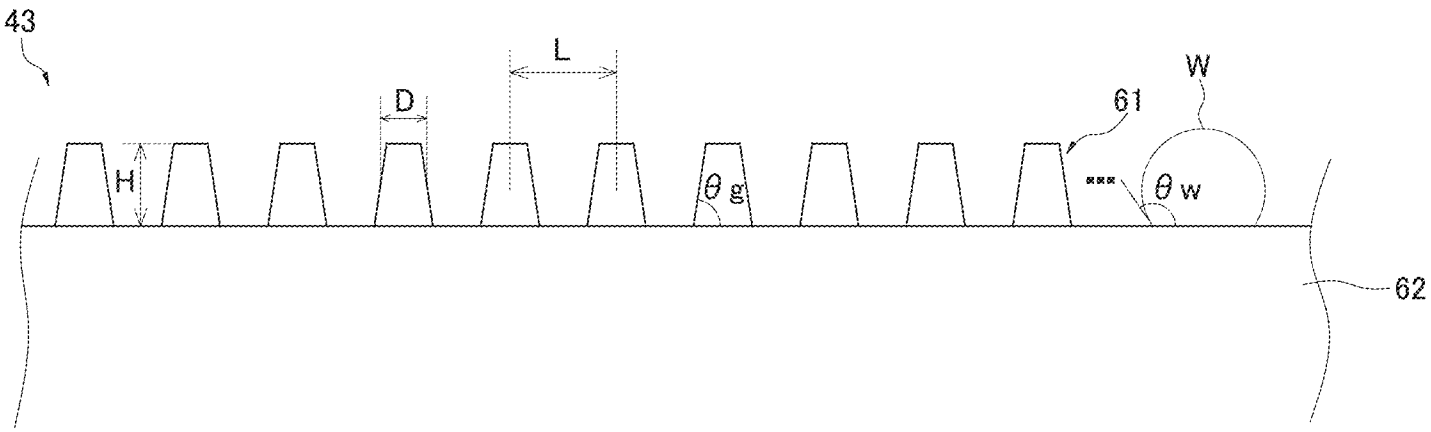
FIG. 7 is a schematic sectional view of the vicinity of a surface of the fin in a case where protrusions have a conical frustum shape.
Figure 8:
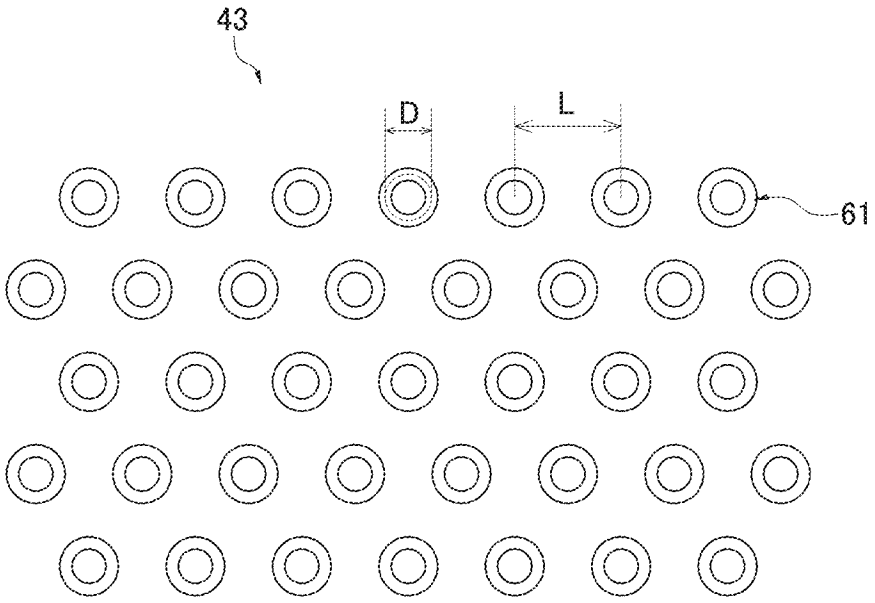
FIG. 8 is a schematic view of the fin viewed in a plate thickness direction.

The fin 43 includes a substrate 62 and a plurality of protrusions 61 provided on a surface of the substrate 62, as illustrated in a schematic sectional view in FIG. 7 of the vicinity of a surface of the fin 43 in a case where the protrusions 61 have a conical frustum shape, and a schematic view in FIG. 8 of the fin 43 viewed in a plate thickness direction. Note that the protrusions 61 and the substrate 62 each have a water-repellent coating film on the surface layer.

(5-1) Substrate 62

The substrate 62 is a plate-like member, and the thickness of the substrate 62 is 70 μm or more and 200 μm or less, or 90 μm or more and 110 μm or less. Further, examples of the material used for the substrate 62 include aluminum, an aluminum alloy, silicon, and the like. Note that a surface of the substrate 62 where the protrusions 61 are not formed is constituted by the water-repellent coating film.

(5-2) Protrusions 61

The protrusions 61 are formed on both surfaces of the substrate 62. The protrusion 61 can have a structure in which, for example, aluminum, an aluminum alloy, silicon, or the like is covered with the water-repellent coating film. However, the protrusion 61 is not limited to having the structure.

Figure 9:
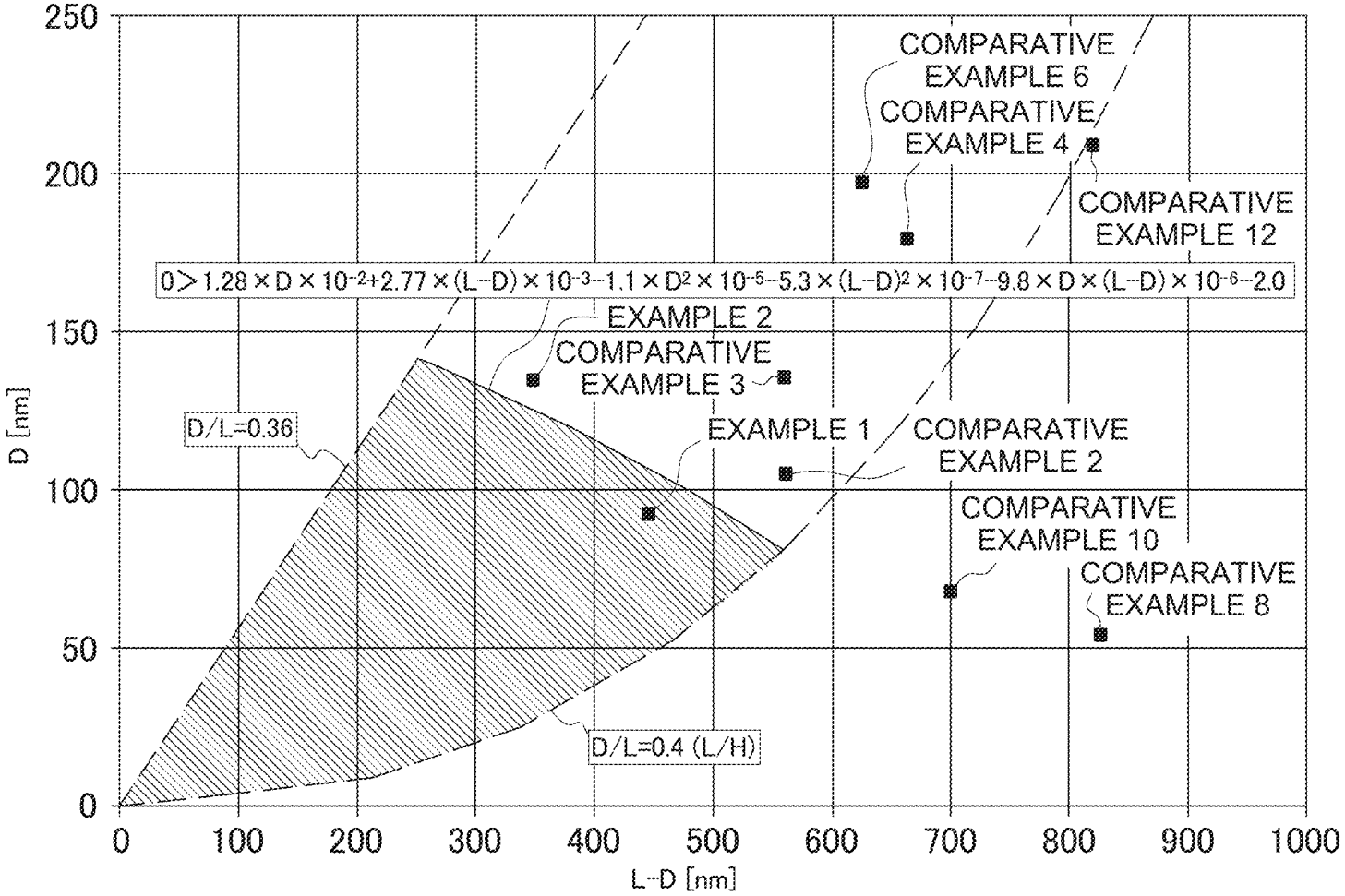
FIG. 9 is a graph illustrating the relationship of Expression 1.

The plurality of protrusions 61 is formed so as to satisfy the relationship of Expression 1, where L is the average pitch of the plurality of protrusions 61 (nm), D is the average diameter of the plurality of protrusions 61 (nm), H is the average height of the plurality of protrusions 61 (nm), and θ is a contact angle of water on a smooth plane of the water-repellent coating film. FIG. 9 is a graph in which the vertical axis represents the average diameter D of the protrusions 61 and the horizontal axis represents the gap (L−D) between the protrusions 61, and an area satisfying the relationship of Expression 1 is indicated by hatching.

[Expression 1]

$$D/L<0.36 \quad (1\text{-}1),$$

$$D/L>0.4\times(L/H) \quad (1\text{-}2),$$

$$D<200\text{ nm},$$

$$L-D<1000\text{ nm}$$

$$H>700\text{ nm} \quad (1\text{-}3),$$

$$0>1.28\times D\times10^{-2}+2.77\times(L-D)\times10^{-3}-1.1\times D^2\times10^{-5}-5.3\times(L-D)^2\times10^{-7}-9.8\times D\times(L-D)\times10^{-6}-2.0 \quad (1\text{-}4),$$

$$90°<\theta<120° \quad (1\text{-}5)$$

Figure 10:
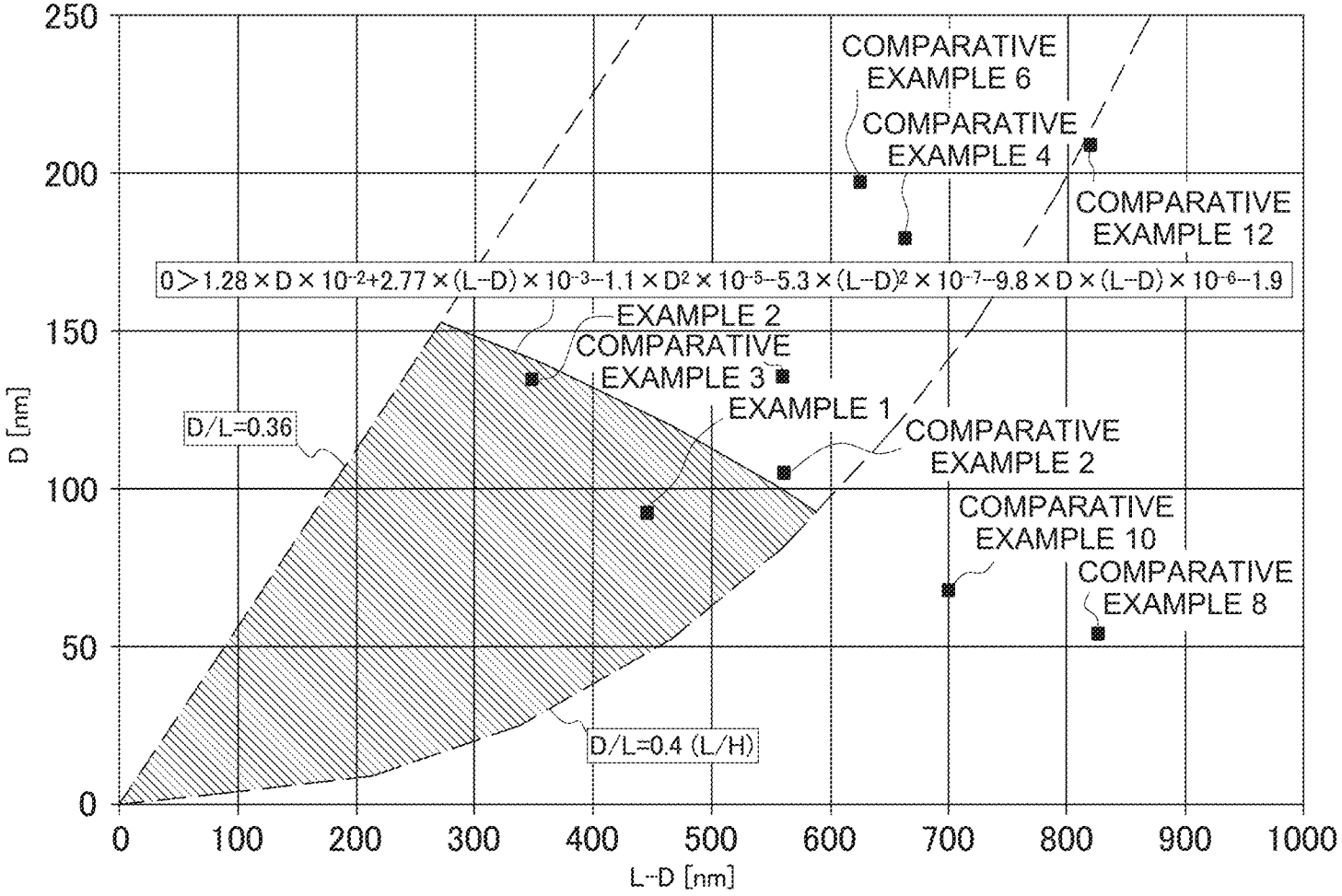
FIG. 10 is a graph illustrating the relationship of Expression 2.

The plurality of protrusions 61 may be formed so as to further satisfy the relationship of following Expression 2. FIG. 10 is a graph in which the vertical axis represents the average diameter D of the protrusions 61 and the horizontal axis represents the gap (L−D) of the adjacent protrusions 61, and an area satisfying the relationship of Expression 2 is indicated by hatching.

[Expression 2]

$$0>1.28\times D\times 10^{-2}+2.77\times(L-D)\times 10^{-3}-1.1\times D^2\times 10^{-5}-5.3\times(L-D)^2\times 10^{-7}-9.8\times D\times(L-D)\times 10^{-6}-1.9 \quad (2\text{-}1)$$

The plurality of protrusions 61 may be formed so as to further satisfy the relationship of following Expression 3.

[Expression 3]

$$H>2700\ \text{nm} \quad (3\text{-}1)$$

Figure 11:
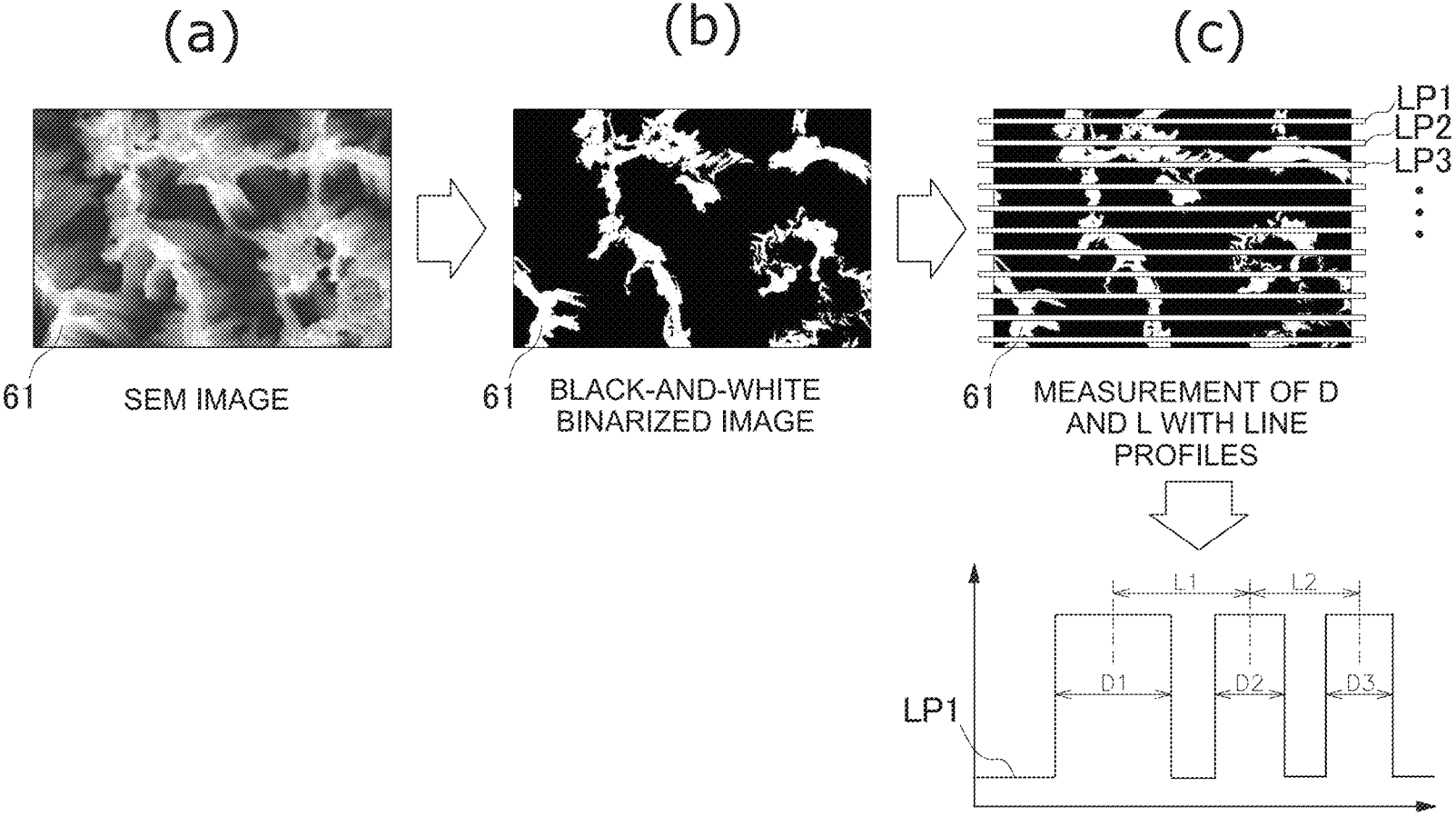
FIG. 11 is a diagram illustrating a method for measuring the average pitch L and the average diameter D of a plurality of protrusions.

The shape of the protrusion 61 is not limited, and examples of the shape include a frustum, such as a conical frustum illustrated in FIG. 7 (a shape obtained by cutting a cone along a plane parallel to the bottom surface and removing a small cone portion), or a pyramidal frustum, a conic solid, such as a cone, a pyramid, or a quadrangular pyramid, a column solid (a tube-shaped solid having two congruent planes as the bottom surface and the top surface), such as a cylinder, a prism, or a quadrangular prism, or a constricted shape (a shape in which the area of the cross section perpendicular to the protruding direction of the protrusion 61 has a minimum value in the protruding direction, such as a shape obtained by removing part of a side surface of a cylinder, a prism, or a conical frustum). The average pitch L of the plurality of protrusions 61 and the average diameter D of the plurality of protrusions 61 can be measured by the following method using a scanning electron microscope (hereinafter abbreviated as a SEM). In the present disclosure, an S-4800 FE-SEM (Type II) manufactured by Hitachi High-Tech Corporation was used for the measurement. FIG. 11 is a diagram illustrating a method for measuring the average pitch L of the plurality of protrusions 61 and the average diameter D of the plurality of protrusions 61.

First, a gray scale image is obtained with the SEM by observing a surface of the fin 43 including the plurality of protrusions 61 in a direction orthogonal to the substrate 62. The observation conditions were that the acceleration voltage was 5.0 kV, the emission current was 10 μA, the working distance (the distance from the lower surface of the objective lens to the focus surface) was 8.0 nm, the inclination angle of the stage was 0°, and the secondary electron detector was an upper detector.

In a case where in the observed SEM image, a blown highlight in which a bright portion whitens due to loss of gradation or black crush in which a dark portion blackens due to loss of gradation occurs, the brightness and the contrast may be appropriately adjusted.

The resolution of the captured image is not limited, and may be 350×500 pixels or more. (a) of FIG. 11 is an example of the observed SEM image.

Next, the obtained SEM image is binarized to obtain a black-and-white binarized image. In the binarization processing, 30% from the upper limit of the red, green, and blue (RGB) values of pixels constituting the SEM image is set as a threshold, pixels brighter than the threshold are set as white, and the other pixels are set as black to generate a black-and-white binarized image. (b) of FIG. 11 is a black-and-white binarized image obtained from the SEM image of (a) of FIG. 11.

By binarizing the SEM image, the peripheries of the top portions of the protrusions 61, which are brightly displayed in the SEM image because the top portions are close to the objective lens, are represented in white, and portions of the SEM image that are far from the objective lens except the top portions of the protrusions 61 are represented in black, so that the boundaries between the top portions of the protrusions 61 and the other area becomes clear.

Note that the above-described threshold is an example, and the threshold can be appropriately set in accordance with the shape of the plurality of protrusions 61, or the like.

Next, line profiles of the obtained black-and-white binarized image are read to measure the average pitch L of the plurality of protrusions 61 and the average diameter D of the plurality of protrusions 61. Specifically, a plurality of line profiles LP1, LP2, LP3, . . . , LPn extending in the same direction is drawn at equal intervals in the obtained black-and-white binarized image, pitches L1, L2, L3, . . . , Ln and diameters D1, D2, D3, . . . , Dn of the protrusions 61 are determined from each line profile LP, and the average pitch L of the plurality of protrusions 61 and the average diameter D of the plurality of protrusions 61 are calculated on the basis of the pitches L1, L2, L3, . . . , Ln and the diameters D1, D2, D3, . . . , Dn of the protrusions 61. The number of the line profiles LP is not limited, and may be 350 or more in a case of an image having the above-described resolution. (c) of FIG. 11 is a schematic view illustrating a state in which the average pitch L of the plurality of protrusions 61 and the average diameter D of the plurality of protrusions 61 are measured using the black-and-white binarized image in (b) of FIG. 11.

Since the boundaries between the top portions of the protrusions 61 and the other area in the black-and-white binarized image are clear by the binarization processing, reading the pitches L1, L2, L3, . . . , Ln and the diameters D1, D2, D3, . . . , Dn of the protrusions 61 using the line profiles is easier than a case of reading from the SEM image.

Figure 12:
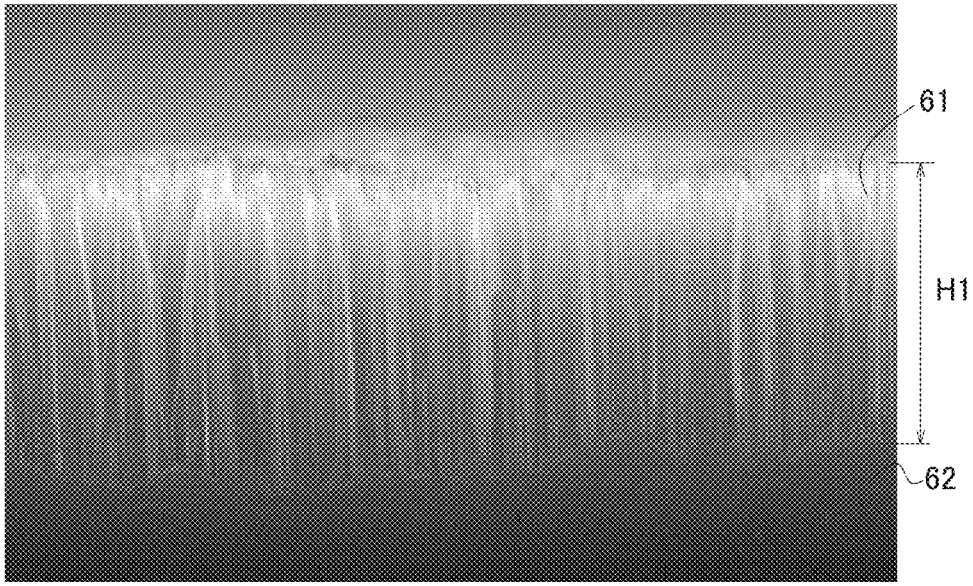
FIG. 12 is a diagram illustrating a method for measuring the average height H of the plurality of protrusions.

The average height H of the plurality of protrusions 61 is measured using an image obtained by observing a cross section of the fin 43 with the SEM. FIG. 12 is a diagram illustrating a method for measuring the average height H of the protrusions 61 using an image obtained by observing a cross section of the fin 43.

As illustrated in FIG. 12, the average height H of the plurality of protrusions 61 is calculated on the basis of the distances H1, H2, H3, . . . , Hn, in an extending direction of the protrusions 61, between the top portions of the protrusions 61 and a surface of the substrate 62, which can be read from an image obtained by observing the cross section of the fin 43.

Note that the average height H of the plurality of protrusions 61 can also be observed under the same conditions as the conditions for the average pitch L of the plurality of protrusions 61 and the average diameter D of the plurality of protrusions 61.

(5-3) Water-Repellent Coating Film

The water-repellent coating film constitutes surface layer portions of the protrusions 61 and the substrate 62. Since the water-repellent coating film has a very small film thickness, the water-repellent coating film does not affect the surface structure of the fin 43 with the protrusions 61.

Specifically, the film thickness of the water-repellent coating film constituting the surface layers of the protrusions 61 and the substrate 62 is, for example, 0.3 nm or more and 20 nm or less, or 1 nm or more and 17 nm or less. Such a water-repellent coating film can be configured as, for example, a monomolecular film of a water-repellent agent.

Examples of the method for forming the water-repellent coating film include a method in which the bonding force between the protrusions 61 or the substrate 62 and the molecules of the water-repellent coating material is larger than the bonding force between the molecules of the water-repellent coating material, and after the water-repellent coating material is applied to the protrusions 61 and the substrate 62, a treatment for cutting only the bonds between the molecules of the water-repellent coating material is performed to remove excess coating material.

As illustrated in FIG. 7, a contact angle Ow of water W on a smooth plane of the water-repellent coating film is $90° < \theta w < 120°$. Thus, it is possible to reduce the contact area between a droplet (water droplet) and the fin 43. Note that $114° < \theta w < 120°$ may be from the viewpoint of sufficiently reducing the contact area between a droplet and the fin 43.

The above water-repellent coating film is not limited and may be an organic monomolecular film containing at least one of fluorine, silicone, or hydrocarbon, or may be an organic monomolecular film containing fluorine. A fluorine-containing monomolecular film can be selected from conventionally publicly known compounds, and for example, silane coupling agents having various fluoroalkyl groups or perfluoropolyether groups can be used. Note that examples of a product for forming a fluorine-containing monomolecular film include 1H,1H,2H,2H-Heptadecafluorodecyltrimethoxysilane (manufactured by Tokyo Chemical Industry Co., Ltd.) and OPTOOL DSX (manufactured by DAIKIN INDUSTRIES, LTD.).

(6) Features

In the outdoor heat exchanger 23 of one or more embodiments, the plurality of protrusions 61 satisfying the relationships of Expressions 1 to 3 is adopted in the surface structure of the fin 43, and the water-repellent coating film having the specific water-repellency is further provided on the surface. Therefore, even in a case where condensed water is generated, a mechanism to be described later allows a droplet that has become large to spontaneously jump (scatter) from the fin 43 not by gravity but by release of excess surface energy. Accordingly, the outdoor heat exchanger 23 including the fins 43 can effectively suppress frost formation by scattering condensed water in a frost formation environment.

Therefore, even in a case where the outdoor heat exchanger 23 is used in a frost formation environment, frost formation can be suppressed by scattering condensed water, and a heating-operation time until a start of defrosting operation can be prolonged. Thus, it is possible to suppress deterioration of comfort in which the defrosting operation is frequently performed and the temperature of the space to be air-conditioned decreases.

Further, although the outdoor heat exchanger 23 of one or more embodiments receives an air flow flowing in a horizontal direction from the outdoor fan 25 (although the outdoor heat exchanger 23 does not receive an air flow flowing in a vertical direction to promote drop of droplets), the adoption of the structure having the specific fine structure and the water-repellency allows droplets to be sufficiently removed from surfaces of the fins 43 only by supplying an air flow in a horizontal direction. In particular, the adoption of the above-described surface structure and water-repellency allows droplets to jump by themselves even in a location where an air flow is not generated or a location where an air flow is weak, and thus can effectively suppress adhesion of frost.

Figure 13:
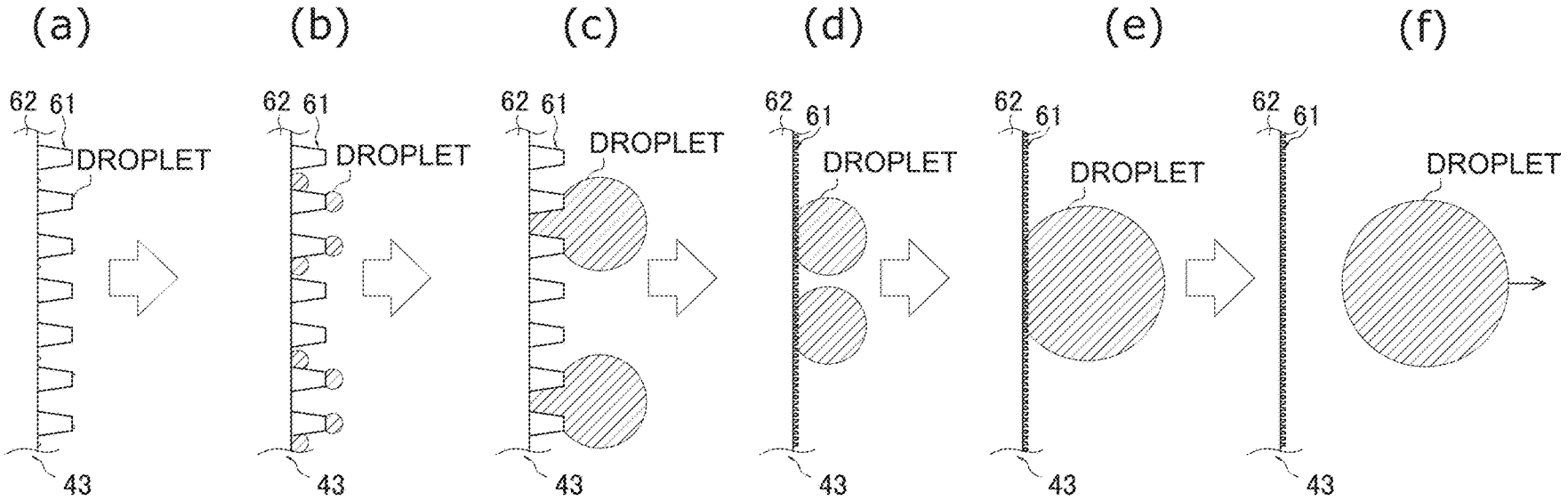
FIG. 13 is a diagram illustrating a mechanism of a phenomenon in which a droplet jumps.

There is no limitation on the mechanism by which a droplet can jump spontaneously due to release of excess surface energy without depending on gravity when the droplet becomes large on a surface of the fin 43, but the mechanism can be considered as illustrated in FIG. 13, for example.

First, as illustrated in (a), on a surface of the fin 43 of the outdoor heat exchanger 23 functioning as an evaporator of the refrigerant, fine droplets (having a diameter of about several nm) serving as nuclei are condensed and generated. Next, as illustrated in (b), the generated nuclei grow and the particle diameters of the condensed droplets increase. Thereafter, as illustrated in (c), the droplets further grow and are into a state in which the droplets adhere to the adjacent protrusions 61 while filling depressions between the protrusions 61 of the fin 43 with the liquid. In addition, as illustrated in (d), the droplets grow so as to extend between the plurality of adjacent protrusions 61, and as illustrated in (e), the adjacent droplets combine together. At the time of the combination of the droplets, the surface free energy changes so as to exceed the binding force of the droplet to the surface of the fin 43, and as illustrated in (f), the droplet spontaneously jumps.

Note that the kinetic energy Ek for the droplet to spontaneously jump can be expressed below by modeling the dynamic relationship where m is the mass of the droplet and U is the moving speed of the jumping droplet.

$$E_k = 0.5\ mU^2 = \Delta E_s - E_w - \Delta E_h - \Delta E_{vis}$$

Here, $\Delta E_s$ indicates the amount of change in the surface free energy at the time of the combination of the droplets, $E_w$ indicates the binding energy received by the droplet from a solid surface, $\Delta E_h$ indicates the amount of change in potential energy (substantially zero because the fin 43 of one or more embodiments extends parallel to a plane orthogonal to a horizontal direction), and $\Delta E_{vis}$ indicates the viscous resistance at the time when the liquid flows.

In the above relational expression, in a case where the droplet is small, the surface free energy generated at the time of the combination is small, so that a spontaneous jump does not occur. Note that at this stage, since the sizes of the droplets are small, even if the ambient temperature is 0° C. or less, the droplets are likely to be maintained in a supercooled state without freezing. Then, it is considered that the spontaneous jump occurs in a case where the surface free energy generated at the time of the combination of the droplets exceeds the binding force to the surface. As described above, it is considered that even in a situation where the sizes of the droplets become large and it is difficult for the droplets to maintain the supercooled state and the freezing easily starts, the droplets jump by the surface free energy generated at the time of combination of the droplets, and are less likely to remain on the surface, and frost formation can be suppressed.

Here, forming the plurality of protrusions 61 so as to satisfy the relationships of Expressions 1 to 3 suppresses the binding force of the surface of the fin 43 on the droplets, and allows the droplets to easily scatter from the fin 43, due to the following reason.

In other words, in a case where the plurality of protrusions 61 is formed so as to satisfy the relationship of (1-1), the intervals between the adjacent protrusions 61 is not excessively narrow. Therefore, the generation of a capillary force between the adjacent protrusions 61 is suppressed.

In a case where the plurality of protrusions 61 is formed so as to satisfy the relationship of (1-2), the intervals between the adjacent protrusions 61 is not excessively wide. Therefore, the generation of an adhesive force between condensed water and the substrate 62 due to the condensed water entering between the adjacent protrusions 61 is suppressed.

In a case where the plurality of protrusions 61 is formed so as to satisfy the relationship of (1-3), the distances between the distal ends of the protrusions 61 and the substrate 62 are ensured, and thus condensed water adhering to the distal ends of the protrusions 61 is suppressed from coming into contact with the substrate 62. Therefore, the generation of an adhesive force between condensed water and the substrate 62 due to the condensed water entering between the adjacent protrusions 61 is suppressed.

In addition, in a case where the plurality of protrusions 61 is formed so as to satisfy the relationship of (1-4), the increase in the particle diameters of droplets entering between the adjacent protrusions 61 is suppressed.

In this way, forming the plurality of protrusions 61 so as to satisfy the relationship of Expression 1 suppresses the generation of the capillary force and the adhesive force that are binding forces of the surface of the fin 43 on the droplets, and the increase in the particle diameters of the droplets. Therefore, in the fin 43 in which the plurality of protrusions 61 is formed so as to satisfy the relationship of Expression 1, the droplets generated on the surface can easily scatter.

Further, in a case where the plurality of protrusions 61 is formed so as to satisfy the relationship of (2-1), condensed water entering between the adjacent protrusions 61 becomes smaller. Therefore, in the fin 43 in which the plurality of protrusions 61 is formed so as to satisfy the relationship of Expression 2, the increase in the particle diameters of the droplets is further suppressed, and the droplets generated on the surface can more easily scatter.

In addition, in a case where the plurality of protrusions 61 is formed so as to satisfy the relationship of (3-1), since distances between the distal ends of the protrusions 61 and the substrate 62 are more ensured, condensed water adhering to the distal ends of the protrusions 61 is more reliably suppressed from coming into contact with the substrate 62. Therefore, also in the fin 43 in which the plurality of protrusions 61 is formed so as to satisfy the relationship of Expression 3, the generation of the binding force of the surface of the fin 43 on the droplets is further suppressed, and the condensed water can more easily scatter.

In this way, adjusting the average pitch, the average diameter, and the average height of the plurality of protrusions 61 can control the particle diameters of the droplets scattering from the surface of the fin 43. In one or more embodiments, a first particle diameter, which is the maximum particle diameter of droplets scattering from a surface of the fin 43, may be equal to or smaller than a second particle diameter, which is the minimum particle diameter of droplets that start to freeze on the surface of the fin 43 under predetermined first conditions under which droplets condense on the surface of the fin 43. Thus, it is possible to scatter (jump), by the above-described mechanism, droplets having the first particle diameter by condensing and growing on the surface of the fin 43.

The first conditions are conditions under which droplets condense on a surface of the fin 43 when the refrigerant cycle apparatus 100 performs the refrigerant cycle. The first conditions include, for example, the relative humidity of air around the fin 43 and the temperature of a surface of the fin 43 when the refrigerant cycle apparatus 100 is in the heating-operation mode and the outdoor heat exchanger 23 functions as an evaporator. Specifically, the first conditions are a state in which the relative humidity of air around the fin 43 is 83%, and the temperature of a surface of the fin 43 is −8.0° C.

The first particle diameter is the maximum particle diameter at which droplets that have condensed and grown on a surface of the fin 43 are scattered. As described above, the first particle diameter is controlled by adjusting the average pitch, the average diameter, and the average height of the plurality of protrusions 61. Specifically, the first particle diameter is 95 μm, or 64 μm.

The second particle diameter is the minimum particle diameter of a droplet that begins to freeze on a surface of the fin 43. In general, a droplet has a property that the smaller the particle diameter is, the higher the degree of subcooling is (the droplet is less likely to freeze). Therefore, as a droplet that has condensed on a surface of the fin 43 grows and becomes larger in particle diameter, the degree of subcooling decreases and the droplet is more likely to freeze. Therefore, in a case where a condensed droplet is grown under a predetermined temperature condition, the droplet whose particle diameter has exceeded a predetermined critical value starts to freeze. The second particle diameter is the minimum particle diameter of a condensed droplet that starts to freeze in a case where the droplet is grown under the first conditions. Specifically, the second particle diameter is 117 μm.

Since a droplet has a property that the smaller the particle diameter is, the higher the degree of subcooling is (a droplet is less likely to freeze), it is necessary to scatter generated droplets from a surface of the fin 43 while the particle diameters are small in order to suppress frost formation on the surface of the fin 43. In one or more embodiments, a first particle diameter, which is the maximum particle diameter of droplets scattering from a surface of the fin 43, is set to be equal to or smaller than a second particle diameter, which is the minimum particle diameter of droplets that start to freeze under the predetermined first conditions under which droplets condense on a surface of the fin 43. Thus, the outdoor heat exchanger 23 using the fins 43 can scatter, before freezing, droplets that condense and grow on surfaces of the fins 43 under the first conditions, and therefore can effectively suppress frost formation.

(7) Method for Manufacturing Outdoor Heat Exchanger 23

Figure 14:
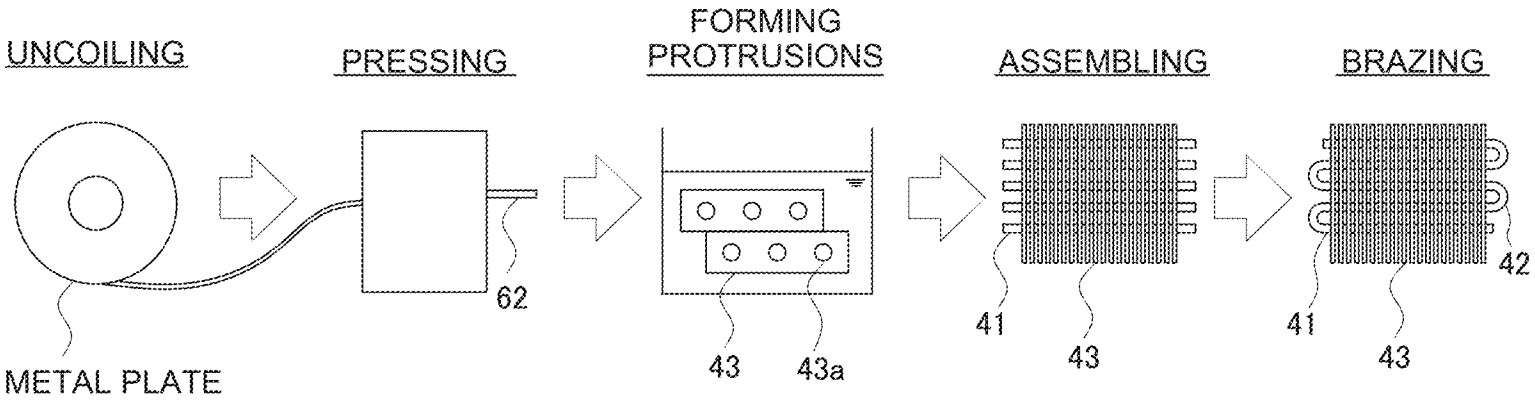
FIG. 14 is a schematic view illustrating a method for manufacturing the outdoor heat exchanger.

Next, a method for manufacturing the outdoor heat exchanger 23 will be described. FIG. 14 is a schematic view illustrating a method for manufacturing the outdoor heat exchanger 23. The method for manufacturing the outdoor heat exchanger 23 according to one or more embodiments includes uncoiling, pressing, forming the protrusions 61, assembling, and brazing.

In the uncoiling, a band-shaped metal plate wound in a coil shape is uncoiled and sent to the pressing. The metal plate is made of, for example, an aluminum alloy.

Figure 6:
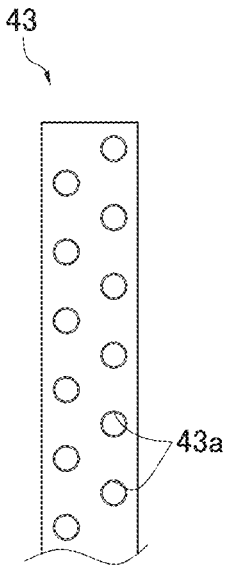
FIG. 6 is a schematic external view of a fin as viewed in a direction normal to a main surface of the fin.

In the pressing, the metal plate, which is a plate-shaped material, is pressed with a pressing machine to be formed into the shape of the fin 43 illustrated in FIG. 6 to be a substrate 62. The substrate 62 is sent to the forming the protrusions 61.

The forming the protrusions 61 includes performing a surface treatment to form a surface structure including a plurality of protrusions 61 on a surface of the substrate 62. The surface treatment changes the substrate 62 into a fin 43.

The fin 43 is sent to the assembling. Details of the surface treatment in the forming the protrusions 61 will be described later.

In the assembling, heat transfer tubes 41 are inserted into insertion openings 43*a* and expanded to assemble the fins 43 and the heat transfer tubes 41. The assembled fins 43 and heat transfer tubes 41 are sent to the brazing.

In the brazing, the fins 43 and the heat transfer tubes 41 are brazed together. Further, U-shaped tubes 42 are brazed to end portions of the heat transfer tubes 41. Instead of the U-shaped tubes 42, headers may be brazed. As a result, the outdoor heat exchanger 23 is completed.

Figure 15:
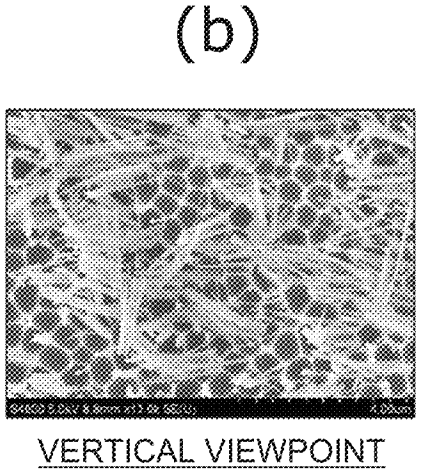
FIG. 15 includes SEM images obtained by capturing surface structures formed on surfaces of the fins.
Figure 15:
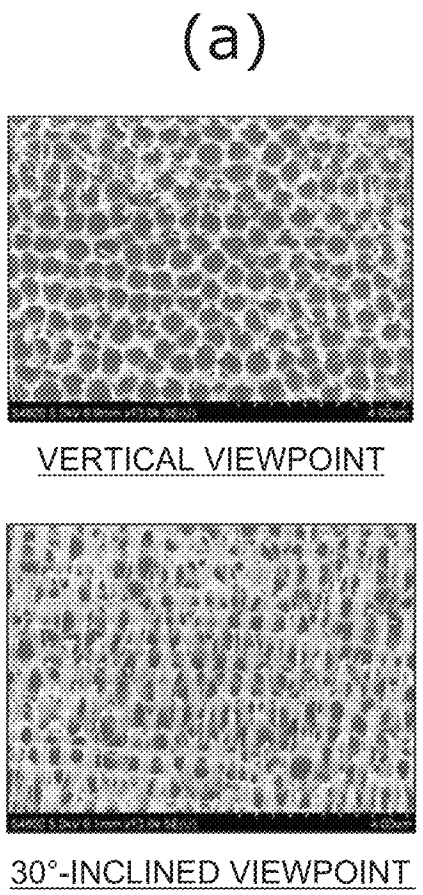

FIG. 15 includes SEM images obtained by capturing surface structures formed on surfaces of the fins 43. (a) of FIG. 15 includes a vertical-viewpoint image and a 30°-inclined-viewpoint image of a surface of the fin 43 manufactured by the method for manufacturing a heat exchanger according to one or more embodiments. On the other hand, (b) of FIG. 15 is a vertical-viewpoint image of a surface of the fin 43 subjected to the pressing performed after the performing the surface treatment to form the surface structure including the protrusions 61. In other words, (b) of FIG. 15 is an image of a surface of the fin 43 formed by the method for manufacturing the outdoor heat exchanger 23 according to one or more embodiments illustrated in FIG. 14 in which the order of the pressing and the forming the protrusions 61 is reversed.

In the images illustrated in (a) of FIG. 15, it is confirmed that the protrusions 61 maintain upright shapes. On the other hand, in the image illustrated in (b) of FIG. 15, it is confirmed that many of the protrusions 61 fall and the shapes of the protrusions 61 are not maintained. This is because the pressing after the performing the surface treatment to form the surface structure including the protrusions 61 crushes the protrusions 61 and destroys the surface structure. The fin 43 in which the protrusions 61 are crushed and the surface structure is destroyed limits the above-described function of scattering droplets.

As described above, the method for manufacturing a heat exchanger according to one or more embodiments includes, after the pressing, the performing the surface treatment to form the surface structure including the protrusions 61, the destruction of the protrusions 61 after the surface treatment is suppressed. Therefore, the present method for manufacturing a heat exchanger can efficiently manufacture a heat exchanger capable of effectively suppressing frost formation by scattering condensed water.

Further, a method for manufacturing a heat exchanger including the pressing after the performing the surface treatment sends a metal plate which is only uncoiled and whose shape is not formed, to the performing the surface treatment. On the other hand, the method for manufacturing a heat exchanger according to one or more embodiments sends the substrate 62 whose predetermined shape has been formed by the pressing, to the performing the surface treatment. Thus, in the method for manufacturing a heat exchanger according to one or more embodiments, the amount of the metal plate to be treated in the performing the surface treatment is smaller than the amount in a method for manufacturing a heat exchanger including the pressing after the performing the surface treatment. Therefore, in a case where a liquid chemical is used in the performing the surface treatment as in an anodic oxidation treatment or an etching treatment described later, the amount of the liquid chemical used can be reduced.

(7-1) Surface Treatment in Forming Protrusions 61

Figure 16:
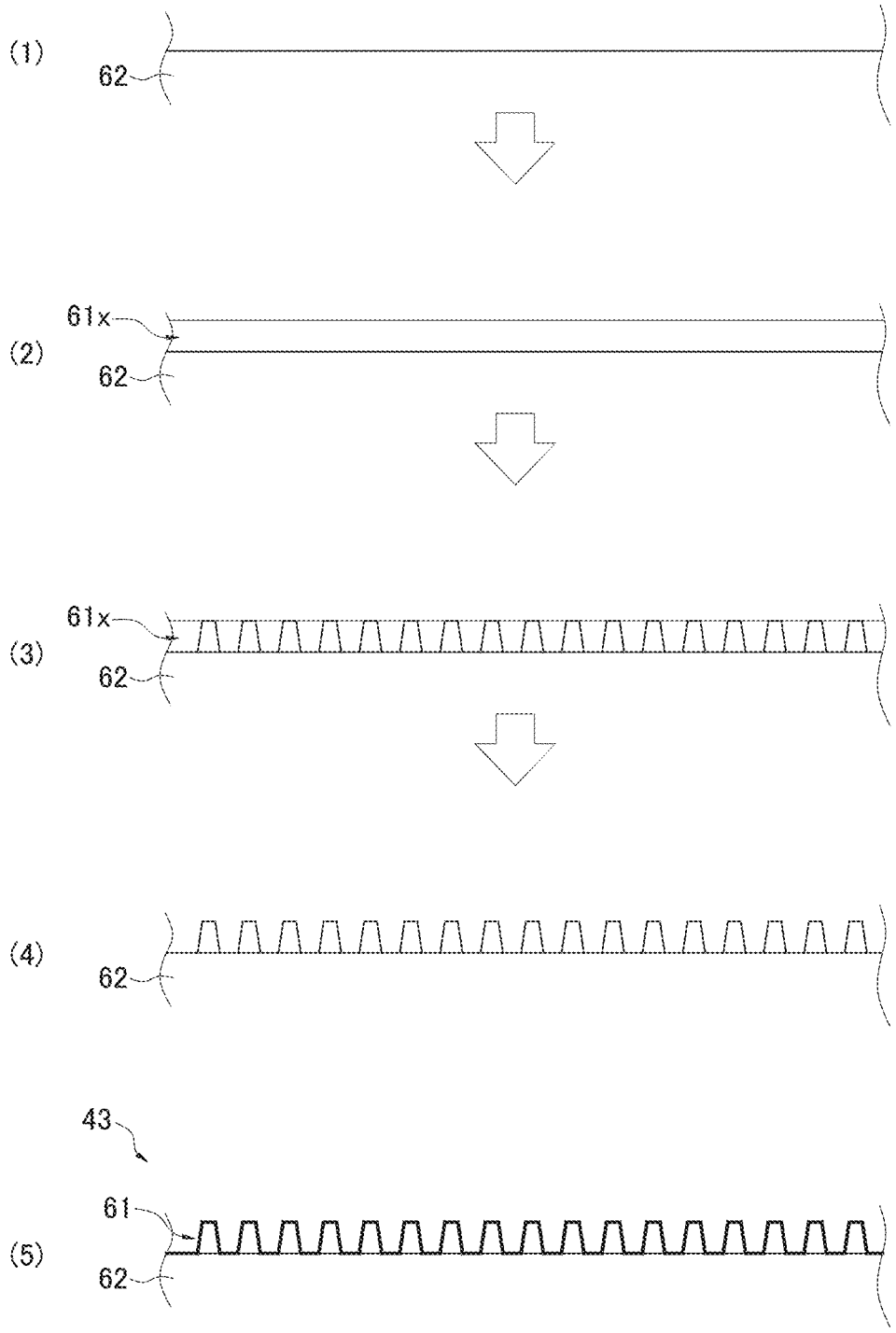
FIG. 16 is a diagram illustrating a manufacturing example of the fin.

Next, the surface treatment in the forming the protrusions 61 will be described. FIG. 16 is a sectional view illustrating the surface treatment in the forming the protrusions 61. In one or more embodiments, a plasma etching treatment is used as the surface treatment.

First, as illustrated in (1), a substrate 62 that is a plate-shaped member having a smooth surface is prepared.

Next, as illustrated in (2), a layer having a specific thickness is formed on a surface of the substrate 62. The layer is composed of an aluminum alloy, silicon, or the like.

Then, as illustrated in (3), masking is performed at specific intervals on the layer formed in (2), and plasma is radiated. The protrusion shape is controlled, such as the average pitch L controlled by the intervals of the masking, and the average diameter D of the protrusions 61 controlled by the shape of the masking. Among others, in a case where the protrusion 61 is shaped into a shape in which the area of the cross section perpendicular to the protruding direction of the protrusion 61 includes at least one minimum value in the protruding direction, the shape of each column forming the protrusion 61 is controlled by adjusting each of the radiation amount and the radiation time of the plasma.

Next, as illustrated in (4), etching is performed to form a protrusion shape having a specific shape and a specific pattern. Here, the height of the protrusions 61 is controlled by the etching time.

Note that the formation of the shape of the protrusions 61 is not limited to the plasma etching treatment, and for example, a publicly known method, such as an anodic oxidation treatment, a boehmite treatment, or an alumite treatment, can be used.

Finally, as illustrated in (5), a water-repellent coating film is formed on surfaces of the protrusions 61 and the substrate 62 on which the protrusions 61 are not formed. Note that selected as a water-repellent coating material for forming the water-repellent coating film is a water-repellent coating material having a bonding force between the protrusions 61 or the substrate 62 and molecules of the water-repellent coating material larger than a bonding force between molecules of the water-repellent coating material. After the water-repellent coating material is applied, excess coating material except the surface layer is washed away. In this way, the shapes of the protrusions 61 before the application can be substantially maintained.

(8) Modifications

The above-described embodiments can be appropriately modified as shown in the following modifications.

(8-1) Modification A

To describe the above embodiments, exemplified is a case where the specific fine protrusions 61 and the water-repellent coating film are provided on surfaces of the fins 43 of the outdoor heat exchanger 23.

However, the specific fine protrusions 61 and the water-repellent coating film may also be provided at other locations to which condensed water may adhere. For example, the specific fine protrusions 61 and the water-repellent coating film described above may also be provided on surfaces of the heat transfer tubes 41 and surfaces of the U-shaped tubes 42 constituting the outdoor heat exchanger 23. In this case, it is possible to suppress adhesion of condensed water at the locations and suppress adhesion of frost due to freezing of the condensed water.

(8-2) Modification B

In the above-described embodiments, the plasma etching treatment is used to form the protrusions 61, but an anodic oxidation treatment and an etching treatment may be used as a method for forming the protrusions 61. The formation of the protrusions 61 using the anodic oxidation treatment and the etching treatment can be performed as described below, for example.

First, a stainless steel material is attached to a cathode connected to a direct-current power source, and a substrate 62 is attached to an anode. In this case, an aluminum material can be used for the substrate 62.

Next, the stainless steel material and the substrate 62 are immersed in a liquid chemical in which a predetermined liquid chemical type is adjusted to a predetermined concentration and temperature.

Next, an anodic oxidation treatment is performed by applying a voltage to the stainless steel material and the substrate 62 for a predetermined treatment time with the direct-current power source.

Used as the liquid chemical type of the liquid chemical used for the anodic oxidation treatment is phosphoric acid, pyrophosphoric acid, oxalic acid, malonic acid, etidronic acid, or a mixed solution thereof, but the liquid chemical type is not limited thereto. The concentration of the liquid chemical type in the liquid chemical is 10 mmol/L or more and 1.0 mol/L or less, 50 mmol/L or more and 1.0 mol/L or less, or 80 mmol/L or more and 1.0 mol/L or less. The temperature of the liquid chemical is not limited, but is a room temperature (15° C. or more and less than 30° C.).

The voltage applied during the anodic oxidation treatment needs to be 40 V or more, and may be a direct-current voltage of 100 V or more, or 200 V or more and 300 V or less.

The treatment time for performing the anodic oxidation treatment needs to be 10 minutes or more, and may be 30 minutes or more. The upper limit of the treatment time is not limited, but can be less than 120 minutes from the viewpoint of production.

When the anodic oxidation treatment is finished, next, an etching treatment is performed by immersing the substrate 62 subjected to the anodic oxidation treatment for a predetermined treatment time, in a liquid chemical in which a predetermined liquid chemical type is adjusted to a predetermined concentration and temperature.

Used as the liquid chemical type of the liquid chemical used for the etching treatment is phosphoric acid, pyrophosphoric acid, oxalic acid, malonic acid, etidronic acid, or a mixed solution thereof, but the liquid chemical type is not limited thereto. The concentration of the liquid chemical type in the liquid chemical is 10 wt % or more and 60 wt % or less, 30 wt % or more and 60 wt % or less, or 40 wt % or more and 60 wt % or less. The temperature of the liquid chemical is not limited, but is 20° C. or more and 60° C. or less, 30° C. or more and 60° C. or less, or 40° C. or more and 60° C. or less.

The treatment time for performing the etching treatment is 5 minutes or more and 30 minutes or less, 10 minutes or more and 25 minutes or less, or 10 minutes or more and 20 minutes or less.

Thereafter, a water-repellent coating film is formed on surfaces of the protrusions 61 and the substrate 62 on which the protrusions 61 are not formed in the same manner as in the above-described embodiments, although the description thereof is omitted.

EXAMPLES

Assessment 1

Assessment plates according to Examples and Comparative Examples were produced, and Assessment 1 for confirming the effect of suppressing frost formation was performed. Hereinafter, Examples and Comparative Examples will be described, but the present disclosure is not limited thereto.

Example 1

Used as an assessment plate according to Example 1 was a silicon substrate of 30 mm by 30 mm on which protrusions 61 were formed by performing a plasma etching treatment for a predetermined time, and then a water-repellent coating film containing a C8 fluorine-based water-repellent material was formed using chemical vapor deposition (hereinafter abbreviated as CVD).

Example 2

Used as an assessment plate according to Example 2 was a silicon substrate of 30 mm by 30 mm on which protrusions 61 were formed by performing an anodic oxidation treatment and an etching treatment under predetermined conditions, and then a water-repellent coating film containing a C8 fluorine-based water-repellent material was formed using the CVD.

The liquid chemical used for the anodic oxidation treatment included etidronic acid as the liquid chemical type, and had a concentration of 0.1 mol/L, and a temperature of 20° C. In the anodic oxidation treatment, a direct-current voltage of 240 V was applied for 30 minutes.

The liquid chemical used for the etching treatment included phosphoric acid as the liquid chemical type, and had a concentration of 50 wt %, and a temperature of 50° C. The etching treatment was carried out for 14 minutes.

Comparative Example 1

Used as an assessment plate according to Comparative Example 1 was an aluminum substrate of 30 mm by 30 mm not provided with protrusions and a water-repellent coating film.

Comparative Examples 2 to 13

Used as an assessment plate according to Comparative Examples 2 to 13 was a silicon substrate of 30 mm by 30 mm on which protrusions were formed by performing an etching treatment for a time different from the time in Example 1, and then a water-repellent coating film containing a C8 fluorine-based water-repellent material was formed using the CVD.

Shape of Protrusion

For each assessment plate, the average pitch L, the average diameter D, and the average height H of the plurality of protrusions were measured by the above-described method using an S-4800 FE-SEM (Type II) manufactured by Hitachi High-Tech Corporation.

Contact Angle

As to the contact angle (static contact angle) of water on a smooth plane of the water-repellent coating film, the measurement was performed at five points on a sample with a water-repellent coating film including a C8 fluorine-based water-repellent material and formed using the CVD, with a contact angle meter Drop Master 701, and water droplets of a volume of 2 μl.

The contact angles of water on flat surfaces of the water-repellent coating film formed in Example 1 and Comparative Examples 2 to 13 were 114°.

Assessment Method

For each assessment plate, a "frost formation start time period" and a "moisture adhesion amount" were measured in a case where one of the surfaces was cooled while air flowing in a direction parallel to the other surface was applied to the other surface. Further, a "frost height" was measured for the assessment plates according to Example 1, and Comparative Examples 1 and 8.

The frost formation start time period is a time period from the start of the assessment to the start of frost adhesion to the other surface. The moisture adhesion amount is an adhesion amount of frost adhering to the other surface after the completion of the assessment. The frost height is a change in the height, in a plate thickness direction of the assessment plate, of the frost adhering to the other surface until two hours elapsed from the start of the assessment.

The assessment plates were cooled under the following conditions.

Dry-bulb temperature: 2° C.

Wet-bulb temperature: 1° C.

Wind speed: 2.5 m/sec

Temperature of cooled surfaces of the assessment plates: −8.0° C.

The assessment plate was cooled using a Peltier element, and the heat flux was measured with a heat flux sensor provided between the assessment plate and the Peltier element.

The moisture adhesion amount was obtained by measuring the difference in the weight of the assessment plate between before and after the assessment with an electronic balance.

The frost height was measured using a laser displacement meter.

Results

Table 1 shows the shapes (the average pitches L−D, the average diameters D, and the average heights H), and the measurement results (the frost formation start time periods and the moisture adhesion amounts) of the plurality of protrusions of the assessment plates according to Examples 1 and 2 and Comparative Examples 1 to 13. Further, the assessment plates according to Examples 1 and 2 and Comparative Examples 2 to 4, 6, 8, 10, and 12 are plotted on the graphs of FIGS. 9 and 10.

As shown in Table 1, the frost formation start time period of the assessment plate according to Example 1 was 54.5 minutes, and the frost formation start time period of the assessment plate according to Example 2 was 35.0 minutes. Both of the assessment plates according to Examples 1 and 2 required a longer time before the start of frost formation than the assessment plates according to Comparative Examples 1 to 13. Further, the moisture adhesion amount of the assessment plate according to Example 1 was 0.406 g, and the moisture adhesion amount of the assessment plate according to Example 2 was 0.455 g. Both of the assessment plates according to Examples 1 and 2 had a smaller moisture adhesion amount than the assessment plates according to Comparative Examples 1 to 13. From the above assessment results, it was confirmed that the assessment plate according to Example 2 can effectively suppress frost formation. Further, it was confirmed that the assessment plate according to Example 1 can more effectively suppress frost formation.

TABLE 1

| | Shape of Protrusion | | | Measurement Result | |
|---|---|---|---|---|---|
| | Average Gap between Protrusions L − D [nm] | Average Diameter D [nm] | Height H [nm] | Frost Formation Start Time Period [min] | Moisture Adhesion Amount [g] |
| Example 1 | 444.8 | 92.4 | 2694 | 54.5 | 0.406 |
| Example 2 | 347.5 | 133.7 | 1530.222 | 35.0 | 0.455 |
| Comparative Example 1 | — | — | — | 4.5 | 0.815 |
| Comparative Example 2 | 560.9 | 105.10 | 2589 | 6.0 | 0.595 |
| Comparative Example 3 | 558.3 | 135.4 | 6319 | 9.0 | 0.625 |
| Comparative Example 4 | 663.4 | 178.7 | 7125 | 6.0 | 0.686 |
| Comparative Example 5 | 1350.4 | 248.4 | 11432 | 15.5 | 0.497 |
| Comparative Example 6 | 624.2 | 197.2 | 13200 | 10.0 | 0.549 |
| Comparative Example 7 | 1359.8 | 78.1 | 3574 | 21.0 | 0.556 |
| Comparative Example 8 | 824.9 | 54.6 | 4300 | 12.0 | 0.568 |
| Comparative Example 9 | 1557.0 | 315.1 | 4947 | 35.5 | 0.513 |
| Comparative Example 10 | 697.9 | 67.8 | 5474 | 33.0 | 0.423 |
| Comparative Example 11 | 1914.4 | 255.6 | 8154 | 22.0 | 0.719 |
| Comparative Example 12 | 819.8 | 208.7 | 6700 | 27.5 | 0.528 |
| Comparative Example 13 | 917.8 | 306.8 | 5700 | 37.0 | 0.659 |

Figure 17:
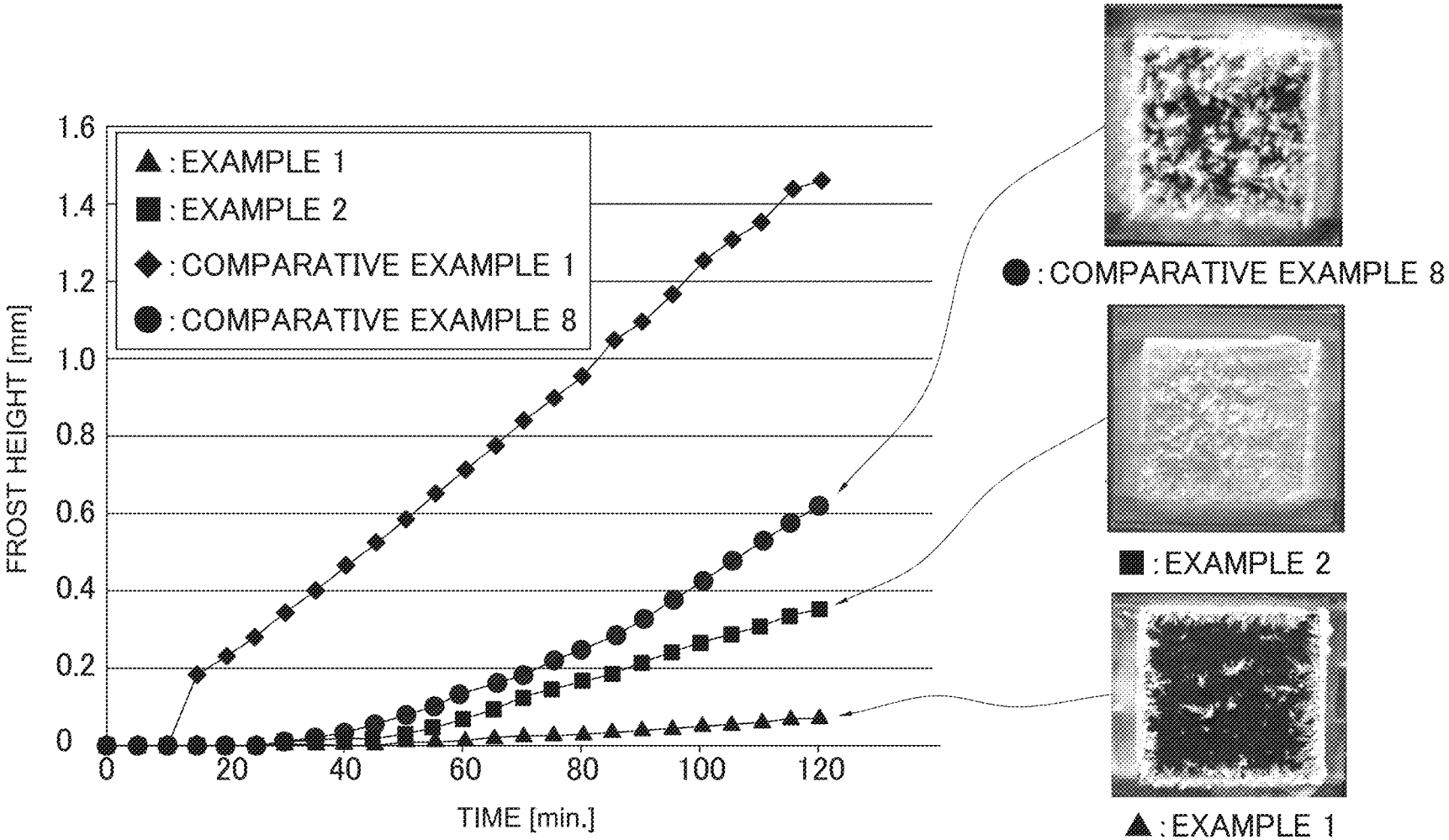
FIG. 17 includes a diagram illustrating changes in frost formation heights of assessment plates according to Example 1 and 2 and Comparative Examples 1 and 8, and images obtained by capturing the surfaces of the assessment plates according to Example 1 and 2 and Comparative Example 8 after two hours from the start of the assessment.

FIG. 17 includes a diagram illustrating changes in frost heights of the assessment plates according to Examples 1 and 2 and Comparative Examples 1 and 8, and images obtained by capturing the surfaces of the assessment plates according to Examples 1 and 2 and Comparative Example 8 after two hours from the start of the assessment.

As illustrated in FIG. 17, it was confirmed that the assessment plates according to Examples 1 and 2 had less frost formation even after two hours than the assessment plates according to Comparative Examples 1 and 8. In particular, it was confirmed that the assessment plate according to Example 1 had less frost formation after two hours than the assessment plate according to Example 2.

Assessment 2

Using the assessment plates prepared in Assessment 1, Assessment 2 was performed to confirm the relationship between frost formation and the particle diameters of droplets.

Assessment Method

In this assessment, the assessment plate of Example 1 and the assessment plate of Comparative Example 8 were used. For each assessment plate, in a case where one of the surfaces is cooled while air flowing in a direction parallel to the other surface was applied to the other surface, the sizes of droplets generated on the other surface was measured.

The sizes of the droplets were measured by analyzing an image obtained by capturing the other surface from the front with a microscope.

The assessment plates were cooled under the following conditions. Note that the following conditions correspond to the above-described first conditions (conditions of humidity and temperature in the fin 43 at a time when the outdoor heat exchanger 23 functions as an evaporator).

Dry-bulb temperature: 2° C.

Wind speed: 2.5 m/sec

Relative humidity: 83%

Temperature of the cooled surfaces of the assessment plates: −8.0° C.

The assessment plates were cooled using a Peltier element.

Results

As a result of the above assessment, as to the particle diameters of the droplets generated on the assessment plate according to Example 1, the average particle diameter was 28.4 μm, and the maximum particle diameter was 64.1 μm. Further, as to the particle diameters of the droplets generated on the assessment plate according to Comparative Example 8, the average particle diameter was 38.2 μm, and the maximum particle diameter was 95.1 μm. From the above assessments, it was confirmed that the assessment plate according to Example 1, which, in Assessment 1, received a confirmation that the assessment plate was capable of effectively suppressing frost formation, was capable of scattering droplets having particle diameters larger than 64.1 μm. Further, it was confirmed that the assessment plate according to Comparative Example 8, which, in Assessment 1, received a confirmation that the assessment plate was capable of only limitedly suppressing frost formation, was capable of scattering droplets having particle diameters larger than 95.1 μm. Thus, it was confirmed that frost formation can be effectively suppressed by performing control to make smaller the particle diameters of the scattered droplets.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

2 OUTDOOR UNIT
10 REFRIGERANT CIRCUIT
20 OUTDOOR-UNIT CONTROL UNIT
21 COMPRESSOR
23 OUTDOOR HEAT EXCHANGER
24 OUTDOOR EXPANSION VALVE
25 OUTDOOR FAN
41 HEAT TRANSFER TUBE
42 U-SHAPED TUBE
43 FIN
50 INDOOR UNIT
51 INDOOR EXPANSION VALVE
52 INDOOR HEAT EXCHANGER
53 INDOOR FAN
57 INDOOR-UNIT CONTROL UNIT
61 PROTRUSION
62 SUBSTRATE
70 CONTROLLER (CONTROL UNIT)
100 REFRIGERANT CYCLE APPARATUS

Patent Literature

[Patent Document 1] Japanese Unexamined Patent Application Publication No. 2018-173265.

What is claimed is:

1. A heat exchanger comprising:

a water-repellent coating film on part of a surface of the heat exchanger, wherein the surface on which the water-repellent coating film is disposed comprises a surface structure comprising protrusions, $$D/L<0.36,$$

$$D/L>0.4\times(L/H),$$

$$D<200,$$

$$L-D<1000,$$

$$H>700,$$

$$0>1.28\times D\times10^{-2}+2.77\times(L-D)\times10^{-3}-1.1\times D^2\times10^{-5}-5.3\times(L-D)^2\times10^{-7}-9.8\times D\times(L-D)\times10^{-6}-2.0, \text{ and}$$

$$90°<\theta<120°, \text{ where}$$

L is an average pitch of the protrusions in nm,

D is an average diameter of the protrusions in nm,

H is an average height of the protrusions in nm, and

θ is a contact angle of water on a smooth plane of the water-repellent coating film.

2. The heat exchanger according to claim 1, wherein $$0>1.28\times D\times10^{-2}+2.77\times(L-D)\times10^{-3}-1.1\times D^2\times10^{-5}-5.3\times(L-D)^2\times10^{-7}-9.8\times D\times(L-D)\times10^{-6}-1.9.$$

3. The heat exchanger according to claim 1, wherein H>2700.

4. The heat exchanger according to claim 1, further comprising:

heat transfer fins; and a heat transfer tube that is fixed to the of heat transfer fins and in which a refrigerant flows, wherein the surface structure is disposed on surfaces of the heat transfer fins.

5. A refrigerant cycle apparatus comprising:

a refrigerant circuit comprising:

the heat exchanger according to claim 1; and a compressor; and a controller that causes the refrigerant circuit to execute:

normal operation in which the heat exchanger functions as an evaporator of a refrigerant, and defrosting operation that melts frost adhering to the heat exchanger, wherein the controller switches to the defrosting operation in response to a predetermined frost formation condition during the normal operation.

6. A refrigerant cycle apparatus comprising:

the heat exchanger according to claim 1; and a fan that supplies an air flow to the heat exchanger, wherein the air flow supplied from the fan to the heat exchanger is in a horizontal direction.

7. A method for manufacturing the heat exchanger according to claim 1, the method comprising:

forming the surface structure of the heat exchanger using an anodic oxidation treatment.

8. The method for manufacturing the heat exchanger according to claim 7, wherein the forming the surface structure comprises an etching treatment after the anodic oxidation treatment.

* * * * *